US005896617A

United States Patent [19]

Kasen et al.

[11] Patent Number: 5,896,617

[45] Date of Patent: Apr. 27, 1999

[54] WATER EXTRACTION CLEANING MACHINE WITH NESTING TANK ASSEMBLY

[75] Inventors: Timothy E. Kasen, Jenison; Stephen J. Simpson, Holland; Charles A. Reed, Jr., Rockford; Luke E. Kelly, Grandville, all of Mich.

[73] Assignee: Bissell Inc., Grand Rapids, Mich.

[21] Appl. No.: 08/741,746

[22] Filed: Nov. 5, 1996

Related U.S. Application Data

[60] Provisional application No. 60/007,289, Nov. 6, 1995, provisional application No. 60/006,665, Nov. 13, 1995, provisional application No. 60/017,175, May 9, 1996, and provisional application No. 60/026,988, Sep. 20, 1996.

[51] Int. Cl.[6] ..... A47L 7/00

[52] U.S. Cl. ..... 15/320; 15/321

[58] Field of Search ..... 15/320, 321

[56] References Cited

U.S. PATENT DOCUMENTS 3,101,505 8/1963 Belicka et al. .
3,491,398 1/1970 Segesman .
4,306,558 12/1981 Kurtz et al. .
4,333,202 6/1982 Block .
4,558,484 12/1985 Groth .
4,559,666 12/1985 Duncan et al. .
4,809,397 3/1989 Jacobs et al. .
5,012,549 5/1991 Williams et al. .
5,383,251 1/1995 Whitaker et al. .
5,406,673 4/1995 Bradd et al. .

FOREIGN PATENT DOCUMENTS 1121225 11/1966 United Kingdom .

*Primary Examiner*—Diana L. Biefeld
*Attorney, Agent, or Firm*—Rader, Fishman, Grauer & McGarry

[57] ABSTRACT

An upright water extraction cleaning machine having an assembly of tanks efficiently stored on and interconnected to the machine is shown. The tank assembly has at least two tanks nested with one another and having one-way valve mechanisms on the bottom thereof. The two tanks are slidably mounted to one another and the tank assembly is slidably mounted and operatively connected to the machine. With this structure, the user can quickly and easily remove and refill the tanks and continue operation of the machine with a minimum amount of interruption and delay.

19 Claims, 16 Drawing Sheets

WATER EXTRACTION CLEANING MACHINE WITH NESTING TANK ASSEMBLY

This application claims the benefit of U.S. provisional applications Ser. No. 60/007,289, filed Nov. 6, 1995; Ser. No. 60/006,665, filed Nov. 13, 1995; Ser. No. 60/017,175 filed May 9, 1996; and Ser. No. 60/026,988 filed Sep. 20, 1996.

BACKGROUND OF THE INVENTION

1. Field of the Invention

This invention relates to cleaning machines and, more particularly, to a water extraction cleaning machine wherein the several tanks used in operation of the machine are mounted to one another in an efficient manner.

2. Description of the Related Art

Water extraction cleaning machines have long been used for removing dirt from surfaces such as carpeting, upholstery, drapes, and the like. The known water extraction cleaning machines can be in the form of a canister-type unit as seen in U.S. Pat. No. 5,237,720 to Blase et al. or an upright unit as seen in U.S. Pat. No. 5,500,977 to McAllise et al. and U.S. Pat. No. 4,559,665 to Fitzwater.

The current water extraction cleaners can be difficult to use and often have limited adaptability for a variety of cleaning conditions. For example, none of the known water extraction cleaners provide means for quickly and efficiently varying the mixture ratio of detergent and water. In addition, none of the known upright water extraction cleaners provide means for automatic adjustment of the height of the roller-type agitation brush in response to changes on the surface being cleaned. Another problem inherent with the known water extraction cleaners is ease of use in filling and emptying the clean water tank and recovery tank. Finally, none of the known prior art water extraction cleaners incorporate means for quickly and easily converting between on-the-floor cleaning and off-the-floor cleaning with an accessory hose and cleaning tool.

SUMMARY OF THE INVENTION

The water extraction cleaning machine according to the invention overcomes the problems of the prior art by providing easy and effective means for removing and refilling the clean and detergent water tanks. In one aspect, the machine according to the invention comprises an upright water extraction cleaning machine having a base supporting a water recovery tank and a handle pivotally mounted to the base, the handle supporting the clean water and detergent tanks. Preferably, the detergent tank nests in a recess provided in the clean water tank to create a tank assembly. The tank assembly is slidably received on the pivoting handle, and latches are provided to hold the tanks in place. Preferably, one-way valve mechanisms are provided on the bottom surfaces of the clean water and detergent tanks, and the valve mechanisms are actuated to the open position when the tanks are properly mounted on the handle.

In another aspect, the machine according to the invention comprises an upright water extraction cleaning machine having a base supporting a tank assembly and a handle pivotally mounted to the base. The tank assembly preferably comprises a dual chamber tank adapted to store clean water and receive dirty water. A recess is provided on the bottom of the dual chamber tank for receiving the detergent tank. As in the first embodiment, the clean water tank and detergent tank include one-way valve mechanisms which are actuated when the tank assembly is seated on the base.

With either of the embodiments described above, the user can quickly and easily remove the tanks from the machine for refilling. In addition, the tanks can be easily replaced and operation of the machine resumed with a minimum amount of effort on the part of the user.

BRIEF DESCRIPTION OF THE DRAWINGS

The invention will now be described with reference to the drawings in which.

DETAILED DESCRIPTION OF THE PREFERRED EMBODIMENTS

Figure 1:
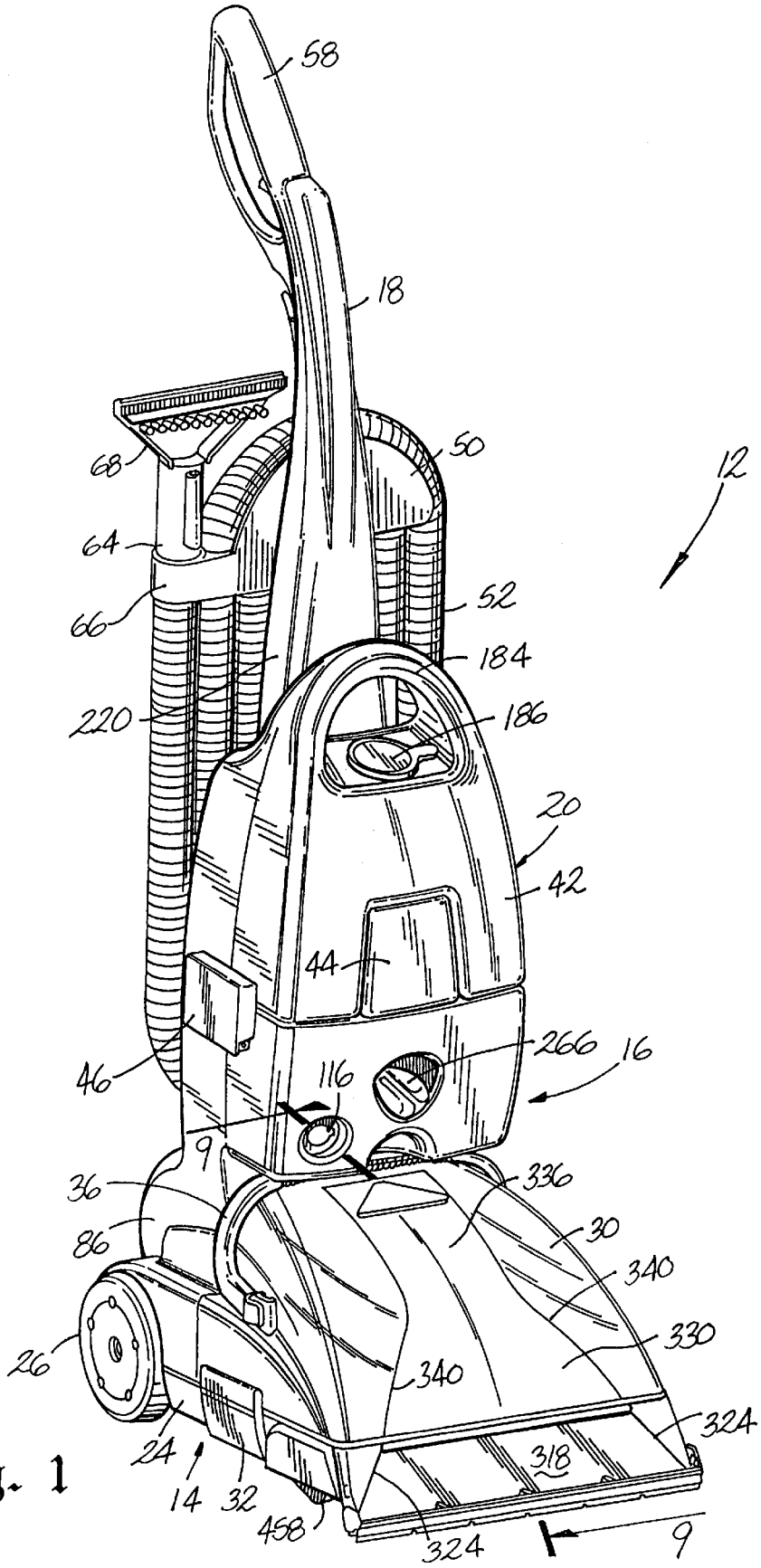
FIG. 1 is a front, perspective view of an upright water extraction cleaning machine according to the invention.
Figure 2:
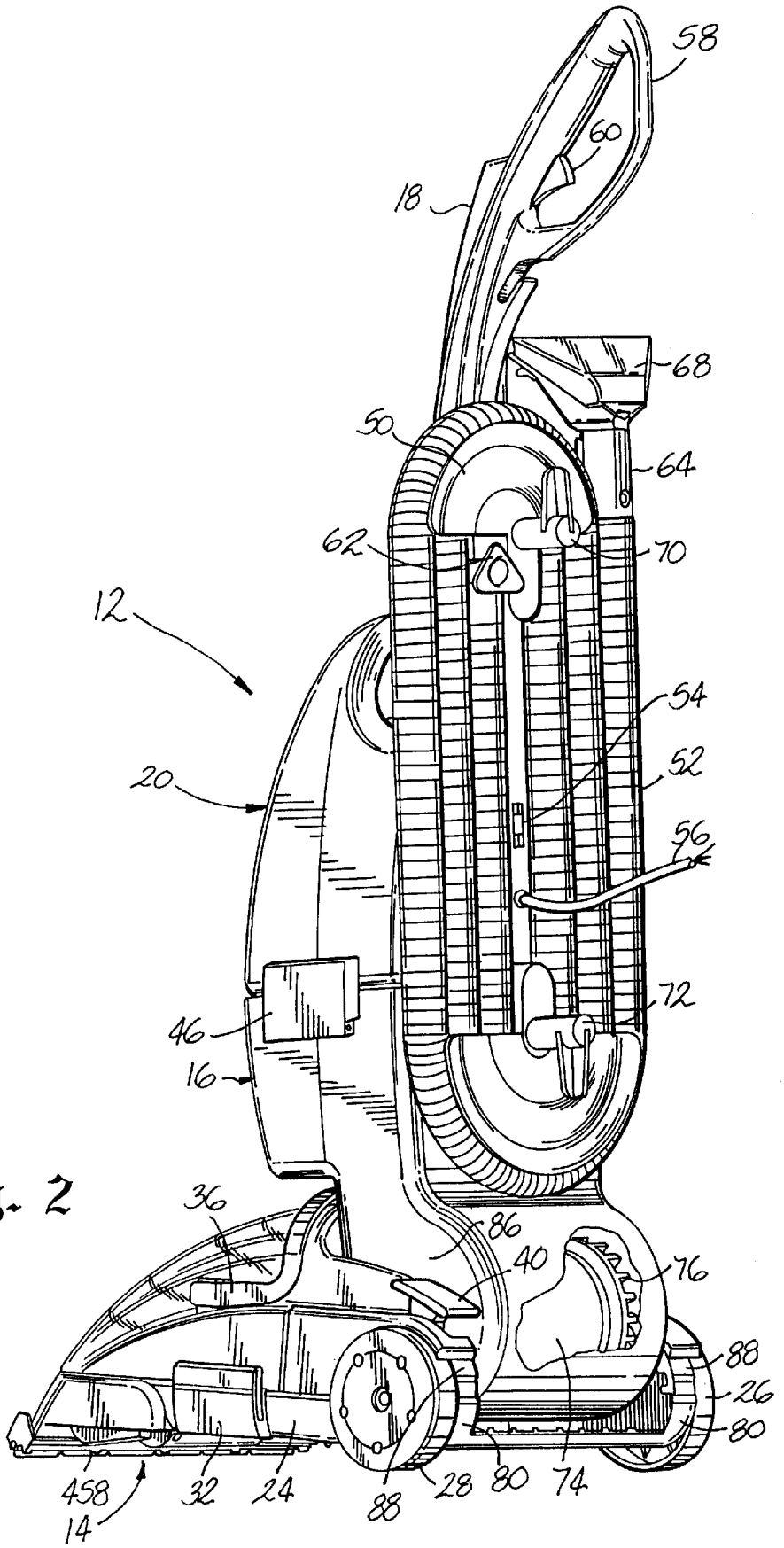
FIG. 2 is a rear, perspective view of the upright water extraction cleaning machine of FIG. 1.

Referring now to the drawings, and to FIGS. 1 and 2 in particular, a first embodiment of an upright water extraction cleaning machine 12 is shown which comprises a base assembly 14, an upper housing 16 pivotally mounted to the base assembly 14, a handle 18 extending upwardly from the upper housing 16, and a tank assembly 20 mounted to and supported by both the handle 18 and upper housing 16.

The base assembly 14 comprises a base pan 24, a pair of rear wheels 26, 28 mounted to the rear of the base pan 24, and a recovery tank 30 removably supported on the base pan 24. A pair of over-center latches 32 are provided, one on each side of the base pan 24, and are adapted to cooperate with a pair of projections 34 (FIG. 10), one provided on each side of the recovery tank sidewall for locking the recovery tank 30 to the base pan 24. A handle 36 is pivotally mounted to the recovery tank 30 for carrying the tank.

As described further below, the tank assembly 20 comprises a clean water tank 42 and a detergent tank 44 which nests inside the front surface of the clean water tank 42. A pair of over-center latches 46 are provided, one on each side of the sidewall of the upper housing 16. The latches 46 are adapted to cooperate with a pair of projections 48 (FIG. 5), one of which is provided on each of the sidewalls of the clean water tank 42, for locking the tank assembly 20 to the upper housing 16 and handle 18.

An accessory hose storage rack 50 is mounted to the rear surfaces of the handle 18 and upper housing 16. The rack 50 is adapted to support and store an accessory hose 52 when the hose is not in use. The accessory hose mounting member 62 is mounted on one end of the hose 52 received in a C-shaped clip provided on the upper end of the rack 50. The flexible body of the hose 52 is wrapped around the top and bottom members of the rack 50, and the grip tube 64 mounted on the other end of the hose 52 is snapped into a C-shaped clip 66 integrally molded into the rack 50. In this position, the entire length of the accessory hose 52 is supported on the rack 50 and is easily transported with and stored on the cleaning machine 12. Preferably, the hose 52 remains on the rack at all times, except when the accessory hose 52 is in use.

The grip tube 64 of the accessory hose 52 is adapted to receive cleaning tools such as the upholstery tool 68 shown in FIGS. 1 and 2. However, any number of a variety of cleaning tools can be received on the grip tube 64 such as a crevice spray tool as seen in U.S. patent application Ser. No. 08/574,769 which is expressly incorporated herein by reference or, alternatively, a window washing tool as seen in U.S. patent application Ser. No. 08/683,608 which is also expressly incorporated herein by reference.

A closed loop grip 58 is provided at the terminal end of the handle 18, and a trigger 60 is pivotally mounted to the handle 18 inside the closed loop grip 58. As described further below, the trigger 60 is used to control the distribution of cleaning solution from the base assembly 14.

A releasable latch 40 is mounted to the base assembly 14 and is adapted to retain the handle 18 and upper housing 16 in the upright, stored position as seen in FIGS. 1 and 2. The handle 18 can be tilted rearwardly by grasping the handle 18 and depressing the latch 40 relative to the base assembly 14. With the latch 40 depressed, the handle is then tilted rearwardly with respect to the base assembly 14.

A three-position electrical switch 54 is mounted to the rear of the handle 18. The three positions of the switch are as follows: (a) all systems off, (b) the "pre-treat" position in which both the cleaning solution pump and agitation brush are on but the vacuum motor is turned off, and (c) the "cleaning position" in which the vacuum motor, agitation brush, and cleaning solution pump are all on.

An electrical cord 56 extends outwardly from the upper housing 16 and is electrically connected to the three-position switch 54. A pair of opposed cord wraps 70, 72 are provided on the top and bottom portions of the storage rack 50 for containing the electrical cord 56 when the machine 12 is not in use.

A large number of the operative components of the machine 12 are mounted to or provided inside the upper housing 16 and handle 18. As noted previously, the tank assembly 20 is supported on the handle 18 and upper housing 16. The vacuum motor 74 and impeller fan 76 are mounted in the round, bulbous, lower portion of the upper housing 16. The upper portion of the upper housing supports a large number of components of the water distribution system such as the solution pump mixing valve which will be described in greater detail below.

Figure 3:
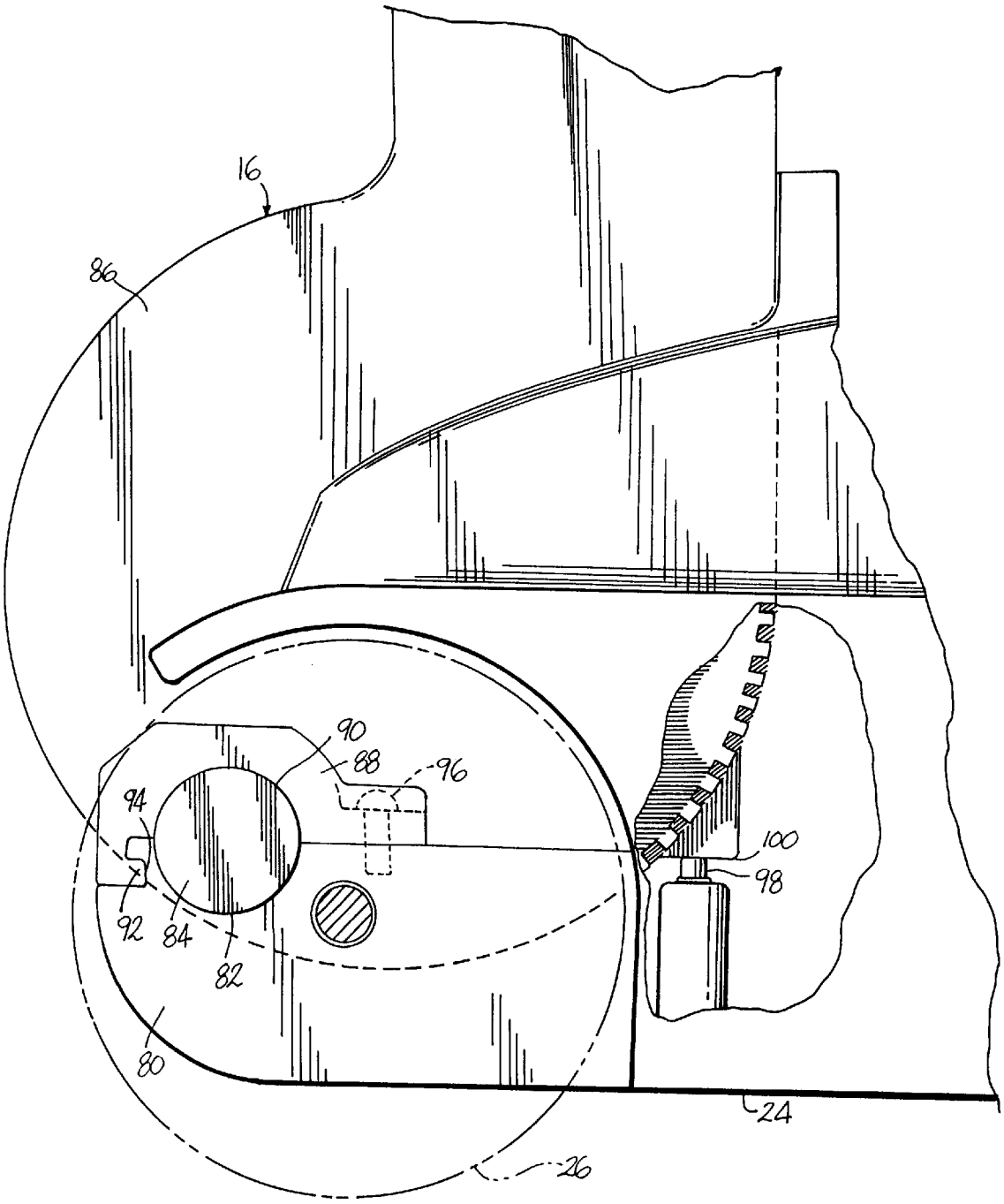
FIG. 3 is a partial, side-elevational view showing the pivot mounting of the upper housing to the base.

FIG. 3 shows the pivot mounting of the upper housing 16 to the base assembly 14. In this side-elevational view, the wheel 26 has been shown in phantom lines to reveal the pivot mounting of these two elements. The pivot mounting is identical for both the right and left sides of the upper housing 16, and therefore, only the right side will be described in detail.

The base pan 24 includes an upwardly extending support member 80 with a semi-circular bearing surface 82 integrally formed therein. A substantially circular boss 84 extends outwardly from the sidewall 86 of the upper housing 16 and is adapted to be received in the bearing surface 82. A retention member 88 having an integrally molded, substantially semi-circular bearing surface 90 formed therein is adapted to be secured to the top surface of the support member 80, thereby capturing the outwardly extending boss 84 of the upper housing 16 between the opposed semi-circular bearing surfaces 82, 90. Preferably, the rear portion of the retention member is secured to the base pan 24 through the sliding engagement of a corresponding projection 92 formed on the retention member 88 in a groove 94 formed on the base pan 24. A conventional fastener such as a screw 96 is provided near the front of the retention member to fixedly secure the retention member to the base pan.

As described further below, the preferred embodiment of the cleaning machine 12 incorporates a rotatably mounted agitation brush which receives the force of rotation from a brush motor mounted to the base pan 24. In any position other than the "off" position for the switch 54, electrical current is supplied to the brush motor for rotating the agitation brush. However, when the accessory hose 52 is being utilized, or when the handle 18 is merely in the upright position and the switch is in either the pretreat or cleaning position, it is undesirable to permit continued rotation of the agitation brush. Therefore, an interrupt switch 98 is provided in the electrical circuit between the brush motor and the source of electricity. The switch 98 is mounted to the base pan 24 and adapted to cooperate with a projection 100 extending outwardly from the front, bottom surface of the upper housing 16. In the position as shown in FIG. 3, the projection 100 bears against the switch 98, thereby opening the electrical circuit between the source of electricity and the agitation brush. Therefore, the brush will not rotate, regardless of the position of the three-position switch 54. Upon rearward titling movement of the handle 18 and upper housing 16 relative to the base assembly 14, the projection 100 will pivot out of contact with the interrupt switch 98 mounted on the base pan 24. Once the projection 100 has moved out of contact with the switch 98, then the switch 98 will assume a closed position and complete the circuit between the source of electricity and the brush motor, assuming that the three-position electrical switch 54 is in any position other than off. Alternatively, the relative position of the switch and projection can be reversed so that the switch is mounted on the upper housing and selectively contacts a projection mounted on the base pan.

With the upper housing 16 and handle 18 pivotally mounted to the base assembly 14, the water extraction cleaning machine can be used in a manner similar to an upright vacuum cleaning machine. In other words, the operator can grasp the closed loop grip 58 and manipulate the base assembly 14 forward and backward over the surface being cleaned.

Figure 4:
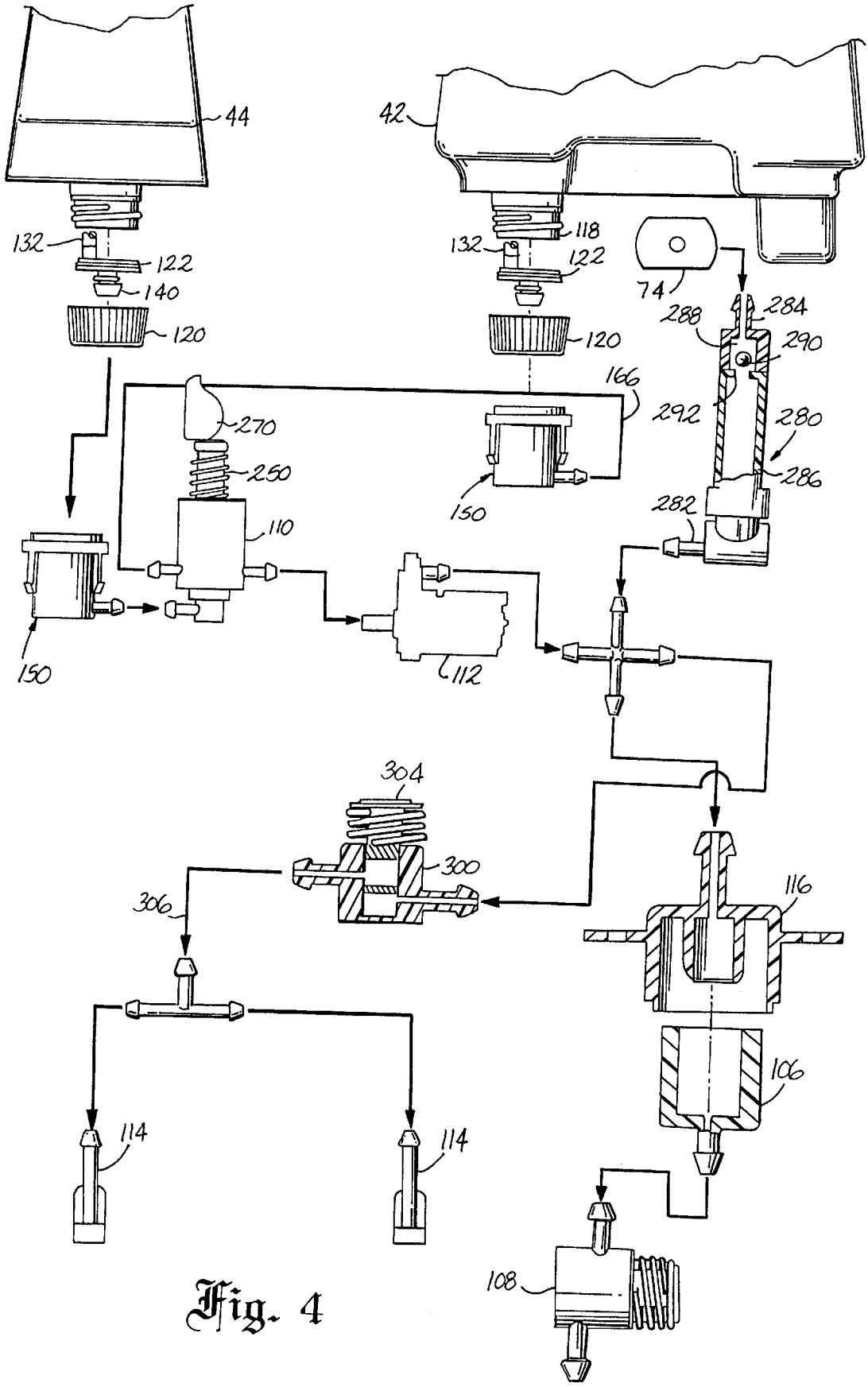
FIG. 4 is a schematic view showing the cleaning fluid distribution system of the cleaning machine of FIG. 1.

FIG. 4 is a schematic representation of the cleaning solution distribution system for the preferred embodiment of the cleaning machine. Generally, clean water and detergent are drawn from the respective tanks 42, 44 to a mixing valve 110 through the operation of a pump 112. The pump 112 then conducts the pressurized cleaning solution to spray nozzles 114 provided on the base assembly 14 or to the trigger valve 108 of the accessory hose 52 through an accessory hose solution tube mounting 116 provided on the front wall of the upper housing 16 and an accessory hose tube connector 106 mounted on the end of the hose 52 opposite the cleaning tool 68.

Figure 5:
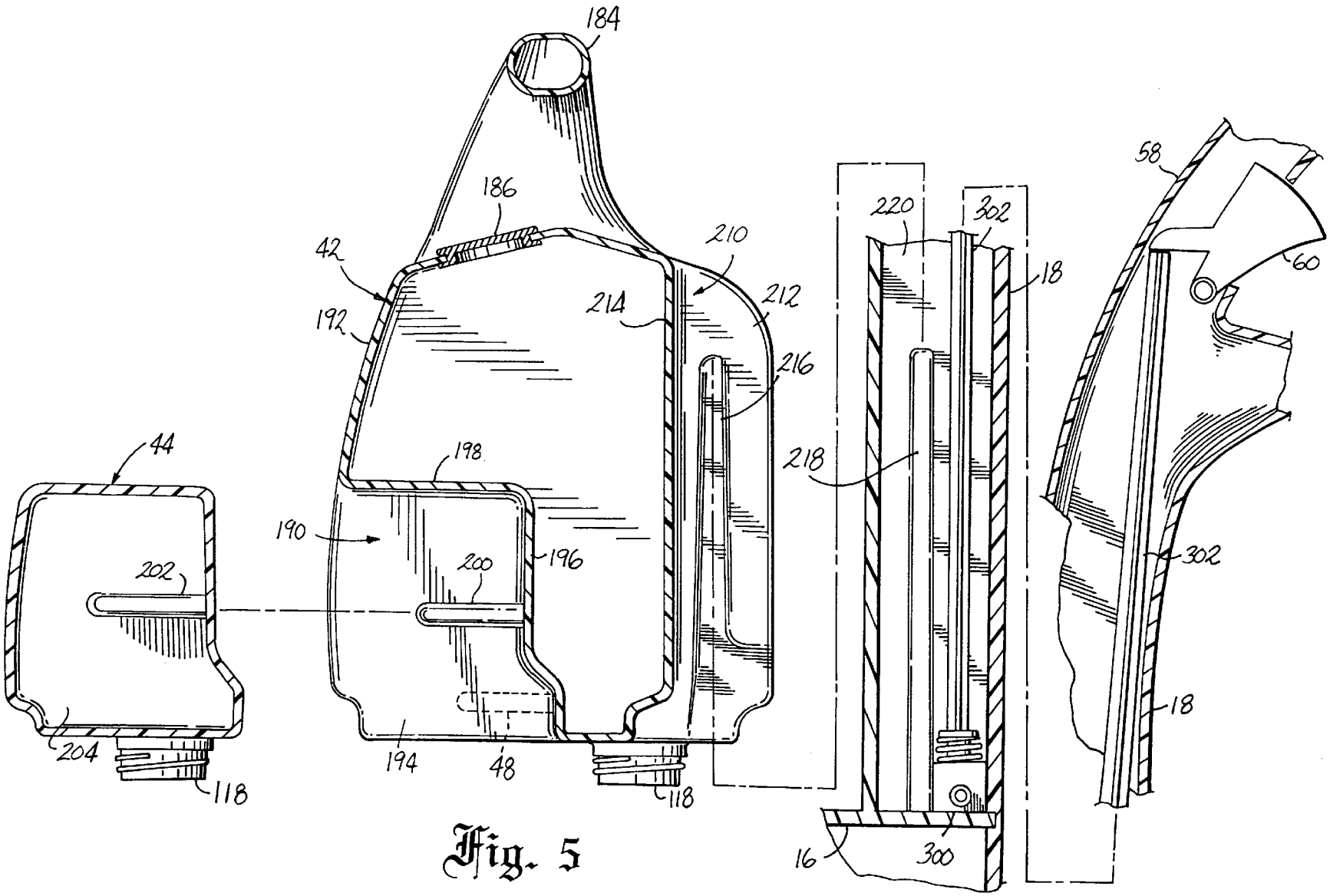
FIG. 5 is a partial, sectional, exploded view of the tank assembly and handle.
Figure 6:
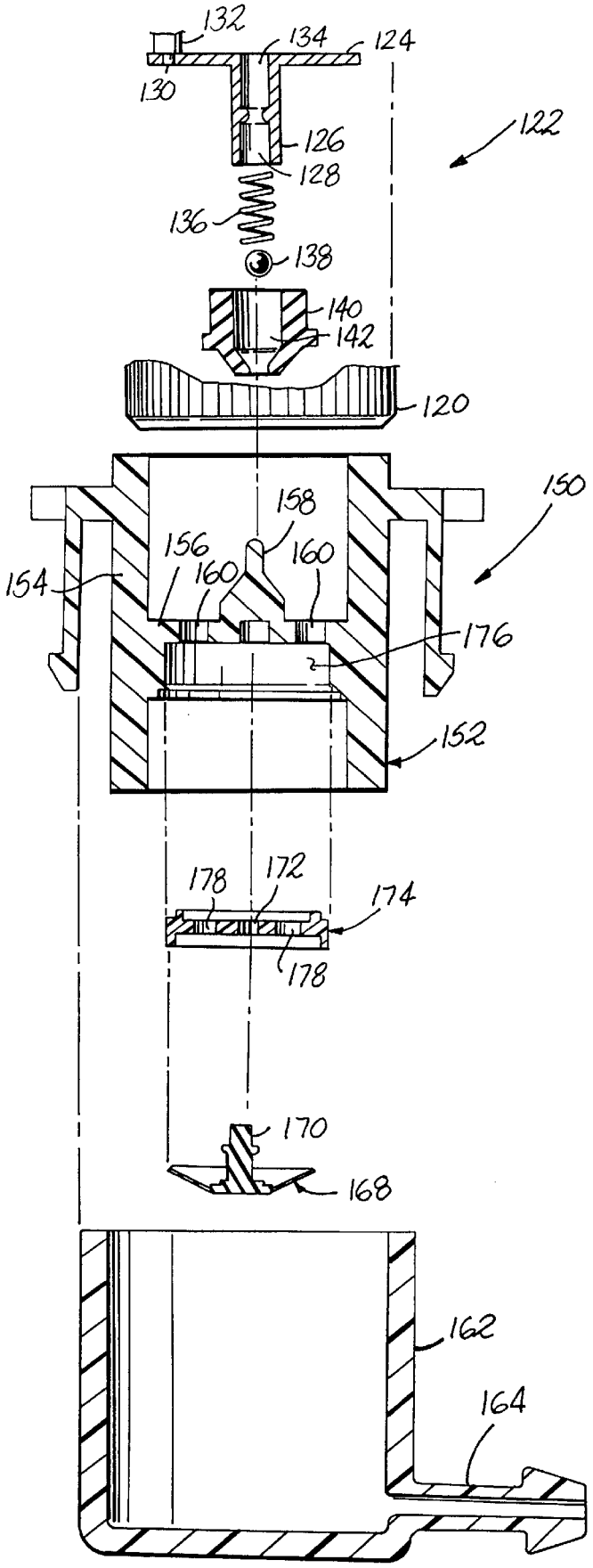
FIG. 6 is a partial, sectional, exploded view of the tank one-way valve and tank seat assembly.

Turning now to the specific structure of the cleaning solution distribution system as seen in FIGS. 4–6, both the clean water tank 42 and a detergent tank 44 include one-way valve mechanisms on the bottom surfaces thereof which cooperate with tank seat assemblies provided on the upper surface of the upper housing 16 to control the flow of fluid from the tank to the other components of the distribution system. The structure of the one-way valves and tank seat assemblies is identical, and therefore, only the structure of the clean tank valve and seat assembly will be described in detail.

The bottom wall of the clean tank has a downwardly extending threaded boss 118 with an aperture extending therethrough. A threaded cap 120 is rotatably received on the boss 118 and mounts a one-way valve member 122 enclosing the aperture of the boss. The valve member 122 comprises a base plate 124 having a downwardly extending boss 126 with a fluid flow aperture 128 extending therethrough and a pressure release aperture 130 and straw 132 extending upwardly therefrom. Preferably, an annular shoulder 134 or other restriction is provided adjacent the top of the fluid flow aperture 128. A spring 136 and ball 138 are adapted to be received inside the flow aperture 128 beneath the shoulder 134, and an elastomeric cap 140 is mounted on the bottom of the boss 126 capturing the ball 138 and spring 136 between the cap 140 and the shoulder 134. A fluid flow aperture 142 is formed in the center portion of the cap 140, and the spring 136 is adapted to bias the ball 138 against the aperture 142 and prevent the flow of fluid therethrough.

The tank seat assembly comprises a seat member having a substantially circular flange extending upwardly and downwardly from a base plate 156. A central projection 158 extends upwardly from the base plate 156, and a plurality of fluid apertures 160 are formed in the base plate 156 intermediate the central projection 158 and the circular flange 154. A reservoir 162 is mounted to the seat member 152 beneath the fluid apertures 160, and a conventional hose mounting 164 extends outwardly from the reservoir 162. A conventional hose 166 is mounted to the hose mounting 164 and fluidly connects the reservoir to the pump 112.

The preferred embodiment of the seat assembly 150 also includes a one-way valve to prevent the back flow of solution from the reservoir 162 past the base plate. The one-way valve comprises an elastomeric umbrella valve member 168 having a central stem 170 extending from one side thereof which is received in an appropriate aperture 172 of a support disc 174. The disc 174 is supported in a suitable recess 176 provided in the seat member 152. The disc 174 has a plurality of flow apertures 178 provided therein, all of which are adapted to be covered by the umbrella valve 168. When either positive fluid pressure is exerted on to the top surface of the umbrella valve 168, or negative fluid pressure is created in the reservoir 162 positioned beneath the valve member 168, then the outer radius of the body of the umbrella valve 168 will deflect downwardly to permit the flow of fluid from the seat member 152 to the reservoir 162.

As described further below, the tanks are received on the handle 18 and upper housing 16 by vertical movement of the tank assembly 20 with respect to the upper housing 16. Eventually, the one-way valves 122 of the tanks will be telescopically received inside the tank seat assemblies 150 so that the central projection 158 extends upwardly through the elastomeric cap 140 of the one-way valve a sufficient distance to dislodge the ball 138 from the cap aperture 142, thereby permitting the flow of fluid through the one-way valve and into the tank seat assembly 150. When the tank is lifted vertically with respect to the upper housing 16, the central projection 158 will be telescopically removed from the cap aperture 142, and the spring 136 will bias the ball 138 of the one-way valve back into sealing position to prevent the inadvertent flow of fluid through the one-way valve.

The tank assembly 20 is configured for easy refilling of the tanks and securing the tanks to the upper housing 16 and handle 18. The clean water tank 42 has an integrally molded carrying handle 184 and a cap 186 closing an aperture 188 formed on the top wall of the tank. The cap 186 can be quickly and easily removed for filling the tank 42 with clean water. As noted above, the clean water is discharged through the boss 126 and one-way valve mechanism provided on the bottom wall of the clean water tank 42.

The detergent tank 44 nests into a recess 190 accessible through the front wall 192 of the clean water tank 42. Preferably, the recess 190 is formed in the front, bottom edge of the clean water tank and is defined by a pair of opposed sidewalls 194, a rear wall 196, and a top wall 198. A pair of substantially horizontal projections 200 are provided on the sidewalls 194 of the recess 190. These projections 200 are adapted to cooperate with a pair of substantially complimentary grooves 202 formed in the sidewalls 204 of the detergent tank 44 for mounting the tanks to one another. The detergent tank 44 is removed from the clean water tank 42 by sliding the detergent tank 44 forward, parallel to the axis of the projections 200 and grooves 202, until the detergent tank 44 is removed from the recess 190.

The detergent tank must be refilled by unscrewing the cap 120 of the one-way valve assembly and removing the valve member 122 to permit refilling of the tank 44 through the boss aperture. Once the tank 44 has been refilled, the one-way valve member 122 and cap 120 are replaced, and the tank 44 is inverted and then slid into the recess 190 of the clean water tank 42.

As noted briefly above, the tank assembly 20 is preferably slidably mounted to the handle 18. The rear wall of the clean water tank 42 includes a U-shaped groove 210 which is substantially complementary to the front portion of the handle 18. The groove 210 is defined by a pair of opposed side 212 and front 214 walls. The sidewalls 212 include a pair of linear grooves 216 which are complementary to a pair of linear projections 218 formed on the sidewalls 220 of the handle 18. The handle projections 218 extend only a portion of the length of the handle 18. The tank assembly 20 is slidably received on the handle 18 by positioning the tank assembly 20 vertically above the upper housing 16 so that the projections 218 and grooves 216 are aligned with one another. Then the tank assembly 20 is lowered so that the tank assembly 20 is slidably received on the handle 18, and the grooves 216 receive the projections 218. The tank assembly 20 is fully received on the handle 18 when the one-way valve assemblies of the tanks 20 engage the seat assemblies 150 provided on the top wall of the upper housing 16. Once the tank assembly is in this position, then the latches 46 can be pivoted onto the projections 48 for locking the tank assembly 20 to the handle 18 and upper housing 16.

Figure 7:
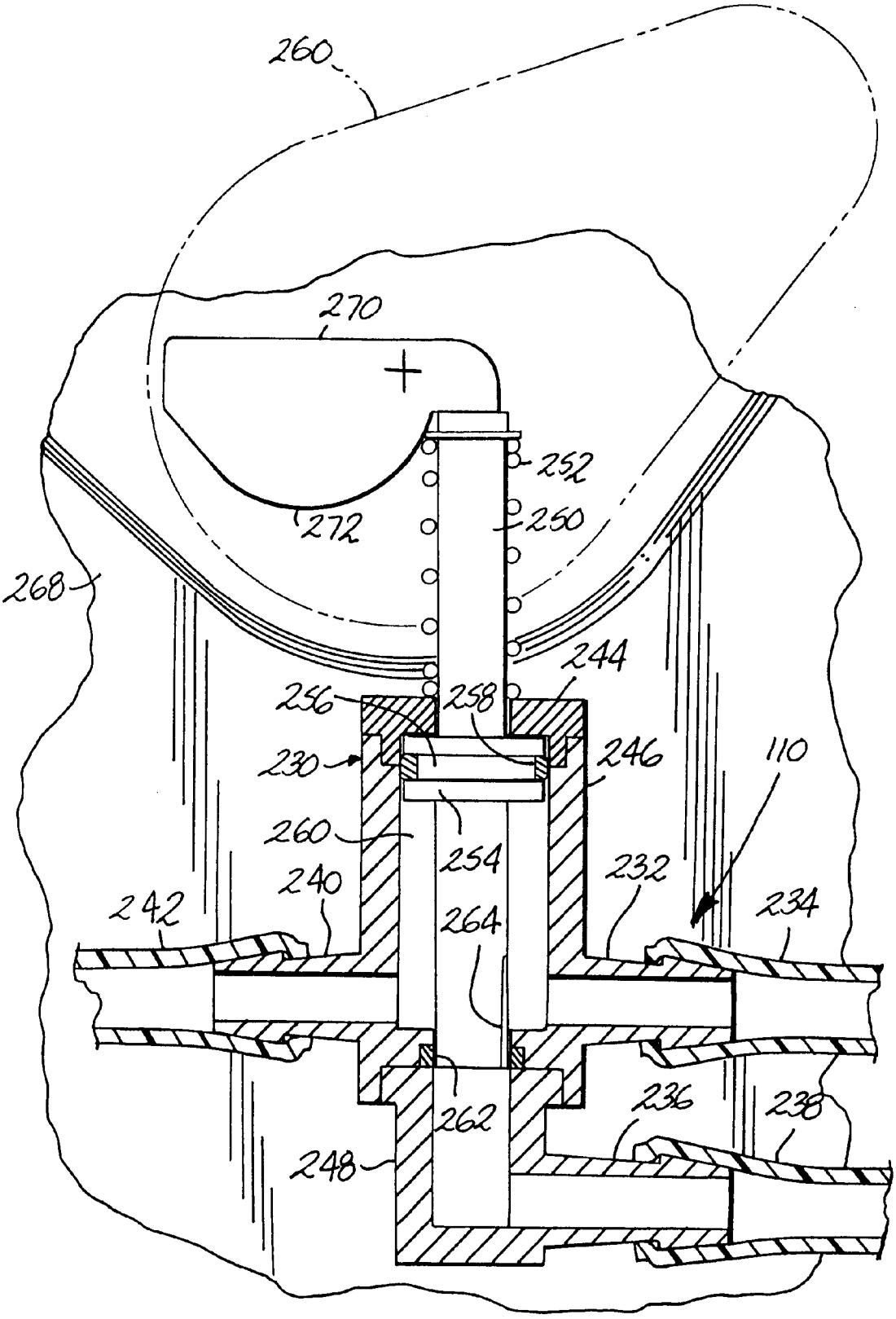
FIG. 7 is a partial, sectional view of the variable fluid mixing valve mechanism shown in a first position.
Figure 8:
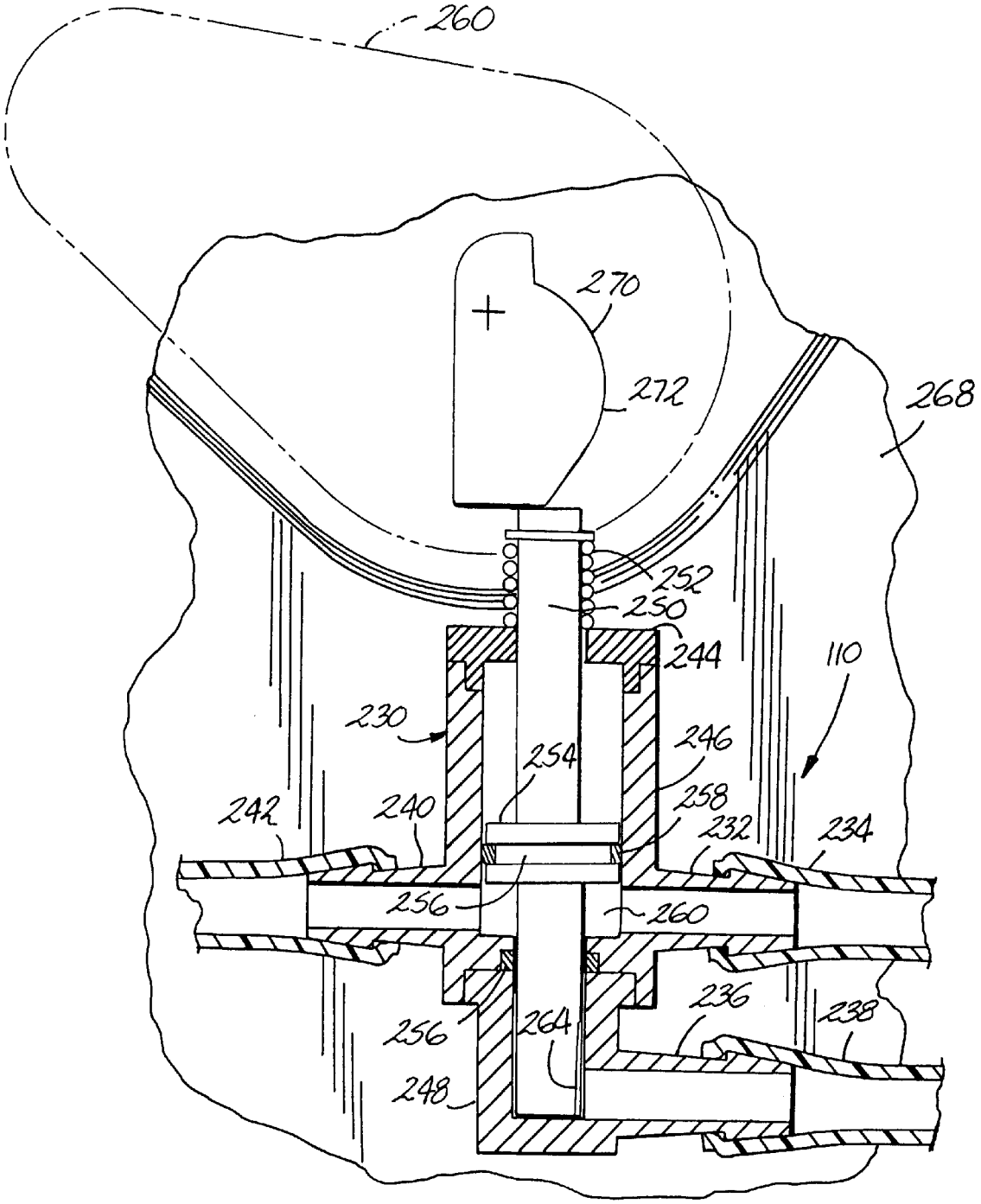
FIG. 8 is a partial, sectional view of the variable fluid mixing valve of FIG. 7 shown in a second position.

Returning to the solution flow schematic diagram seen in FIG. 4, the mixing valve 110 is positioned intermediate the tank seat assemblies 150 and the solution pump 112. Preferably, the mixing valve is a variable mixing valve 110 to accommodate differing mixtures of detergent and clean water. As seen in FIGS. 4, 7, and 8, the variable mixing valve 110 comprises a valve body 230 having a clean water inlet 232 which is fluidly connected to the clean water tank seat assembly 150 by a hose 234 and a detergent inlet 236 which is fluidly connected to the detergent tank seat assembly 150 by a hose 238. A solution outlet 240 is also formed on the valve body 230 and is adapted to conduct the clean water and detergent mixture from the mixing valve 110 to the pump 112 through a hose 242.

The valve body is formed from an end cap 244, a central body portion 246, and an end inlet member 248 mounted to the end of the central body portion 246 opposite the end cap 244. A plunger 250 extends through an aperture in the end cap 244 such that a portion of the plunger 250 is received inside the central body portion 246 and the end inlet member 248, and a portion of the plunger 250 extends outwardly from the end cap 244. A spring 252 is mounted on the exposed portion of the plunger 250 and is adapted to bias the plunger 250 into the extended position, as seen in FIG. 7. A collar 254 positioned along the length of the shaft of the plunger 250 with an annular groove 256 formed therein is adapted to receive an O-ring 258. The collar 254 and O-ring 258 are adapted to create a fluid seal inside the circular valve body and, in cooperation with the central body portion, define a mixing chamber 260 therein. An O-ring 262 is provided in the central body portion 246 immediately adjacent the end inlet member 248. The O-ring 262 cooperates with the plunger 250 to effectively seal the end inlet member 248 and detergent inlet 236 from the mixing chamber 260, depending upon the axial position of the plunger 250 within the valve body 230.

A tapered groove 264 is formed on the end of the plunger 250 opposite the spring 252. The groove 264 extends along the surface of the plunger 250, preferably passes through the end wall of the plunger 250, and is tapered so that the groove 264 has a greater cross-sectional area immediately adjacent the end than it does a spaced distance therefrom. The purpose of the tapered groove 264 is to accommodate varying flow rates of detergent from the detergent inlet 236 into the mixing chamber 260 of the valve body 230.

A control knob 266 is mounted on the front wall 268 of the upper housing 16 for controlling the water/detergent ratio in the cleaning solution delivered to the pump 112. A cam 270 is mounted to the rear surface of the knob 266, and the cam 270 is positioned so that the terminal end of the plunger 250 bears against the contoured surface 272 of the cam 270. FIGS. 7 and 8 depict the two extreme ranges of solution mixtures in the preferred embodiment of the cleaning machine 12. FIG. 7 shows the plunger 250 extended outwardly from the valve body 230 the maximum distance. In this position, the maximum length of the tapered groove 264 is extended into the mixing chamber 260 of the valve. Therefore, the maximum amount of detergent will be drawn into the mixing chamber 260 and ultimately discharged to the pump 112.

FIG. 8 depicts the other extreme position in which the plunger 250 is positioned so that the entire length of the tapered groove 264 is withdrawn from the mixing chamber 260 so that there is no fluid flow communication between the detergent inlet 236 and the mixing chamber 260. Therefore, only clean water will be directed to the pump 112. As is evident, the contoured surface 272 of the cam 270 permits an infinite number of detergent to water mixing ratios between the two extremes shown in FIGS. 7 and 8. In the preferred embodiment, the knob 266 and cam 270 are received in only one of three positions, the water only or "rinse" position as seen in FIG. 8, a maximum detergent to water mixing ratio as seen in FIG. 7, or a standard mixing ratio half-way between the extremes shown in FIGS. 7 and 8. In use, the knob 266 is intended to be positioned at the standard mixing ratio position for the vast majority of cleaning operations. When a high traffic or heavily stained area is encountered, the knob 266 can be rotated to the maximum detergent position as seen in FIG. 7. If a final clean water rinsing operation is desired, then the knob 266 can be rotated to the "water only" position as seen in FIG. 8. The incorporation of the variable mixing valve 110 permits varying the water/detergent mixture ratios to accommodate a wide variety of cleaning situations.

As noted above, the pump 112 is positioned downstream from the variable mixing valve 110. When the pump 112 is energized and primed, the pump 112 will draw fluid from the mixing valve 110 and tank seat assemblies 150 at the prescribed ratio. Preferably, the pump 112 is not a self-priming pump and, therefore, some means should be incorporated to assist priming of the pump 112. As seen in FIG. 4, the fluid flow system includes a pump priming valve 280 which is preferably mounted vertically above the pump 112 and the tank seat assemblies 150 in the base of the handle 18. The pump priming valve 280 is fluidly connected on the bottom end 282 to the outlet of the pump 112 and fluidly connected on the top end 284 to the impeller fan chamber of the vacuum motor 74 (FIG. 2). The pump priming valve 280 comprises a valve body having a fluid aperture extending therethrough wherein the fluid aperture is divided into an elongated fluid chamber 286 immediately adjacent the bottom of the valve and a ball chamber 288 which is positioned immediately adjacent the top end of the valve. Preferably, a small shoulder 292 is formed inside the valve body to define the two chambers, and a ball 290 or conical rubber plug is received inside the ball chamber.

In operation, the pump 112 will be primed with the fluid from the solution tanks by turning the pump 112 on and the vacuum motor 74 on. The vacuum motor 74 will exert negative pressure on the fluid outlet of the pump 112 through the pump priming valve 280 thereby drawing any air between the pump inlets and the solution tanks therethrough. The air will be drawn through the pump priming valve 280 into the vacuum impeller fan chamber or into the recovery tank 30. Preferably, the weight of the ball 290 is coordinated with the amount of negative air pressure applied to the pump priming system from the vacuum motor so that the negative air pressure applied to the ball chamber 288 is insufficient, by itself; to draw the ball 290 upwardly and seal the outlet of the pump priming valve.

As the vacuum motor 74 operates to draw the air from the system, it is likely that some fluid will enter the pump priming valve 280. Preferably, the size of the elongated fluid chamber 286 is dimensioned to accommodate a sufficient amount of fluid to permit full priming of the pump 112. Eventually, the fluid level will rise inside the pump priming valve 280, and fluid will enter the ball chamber 288. The ball 290 is preferably formed of a buoyant material so that as the fluid level rises inside the ball chamber 288, the ball 290 similarly rises until the ball 290 ultimately bears against the outlet and seals the priming valve 280 to prevent solution from flowing therefrom. Once this seal has established, the pump should be sufficiently primed for normal operation.

Following the pump priming valve 280, the pressurized solution is simultaneously directed to the accessory hose solution tube mounting 1 16 and the trigger valve 300. As seen in FIGS. 4 and 5, the trigger valve is positioned in the base of the handle 18 immediately below the bottom end of an actuator rod 302. The rod 302 extends upwardly to pivotally interconnect with the trigger 60 provided in the closed loop grip 58 of the handle 18. In the preferred embodiments, multiple actuator rods 302 are interconnected to traverse the distance between the trigger 60 and the trigger valve 300.

Upon squeezing of the trigger 60 relative to the closed loop grip 58, the actuator rods 302 are displaced downwardly to squeeze the plunger 304 of the conventional trigger valve 300 and permit the flow of fluid therethrough. With the trigger valve 300 in the open position, pressurized fluid flows through a conventional conduit 306 to a pair of spray tips 114 mounted to the base pan 24 immediately adjacent the agitation brush. Preferably, the spray tips 114 are adapted to create a fan-shaped spray pattern which traverses substantially the entire width of the agitation brush and suction nozzle opening.

Figure 9:
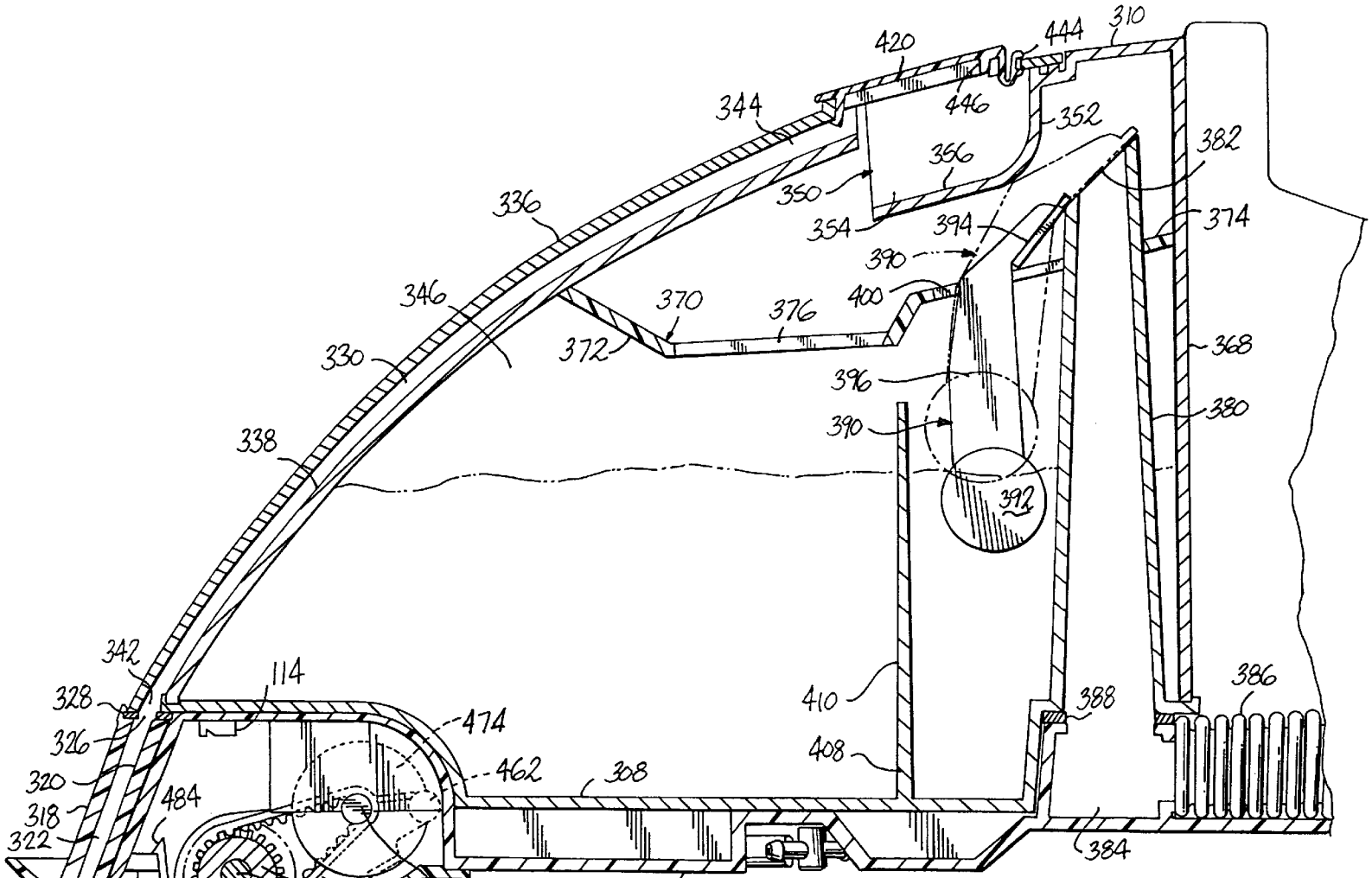
FIG. 9 is a partial, sectional view of the base pan and recovery tank taken along lines 9—9 of FIG. 1.
Figure 10:
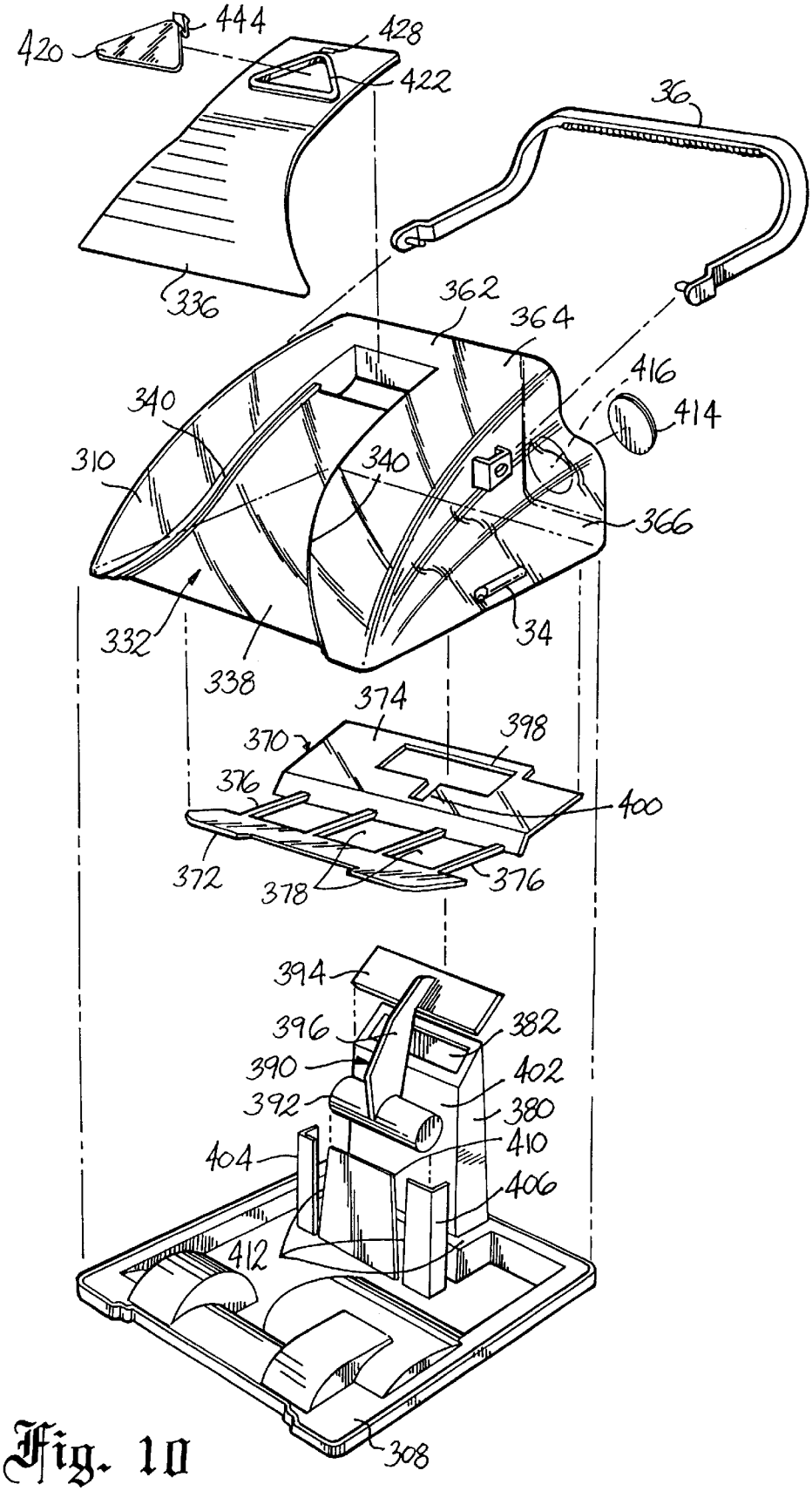
FIG. 10 is an exploded view of the recovery tank assembly.

Turning now to the fluid recovery system, the vacuum motor 74 and impeller fan 76 generate negative air pressure which is communicated from the upper housing 16 to the base assembly 14 for recovery of used solution and dirt. As seen in FIGS. 9 and 10, the working air flow path for on-the-floor cleaning begins at the suction nozzle opening 316 provided at the front, forward edge of the base assembly 14. Preferably, the suction nozzle opening is defined by a front 318 and a rear 320 plate members which are mounted to one another and which also define the initial working air flow conduit 322. The suction nozzle opening 316 extends the entire width of the base assembly 14 and the plate members 318, 320. A pair of sidewalls 324 are integrally formed into the rear plate member to define the sides of the initial flow conduit. Preferably, the sidewalls 324 taper upwardly and inwardly (see FIG. 1). The initial flow conduit terminates at an outlet 326 positioned along the top edges of the plate members and sidewalls. In view of the fact that the sidewalls of the flow conduit taper upwardly and inwardly, the length of the outlet of the initial suction flow conduit is less than the length of the suction nozzle opening and the width of the base assembly 14. Preferably, an elastomeric gasket 328 is mounted to the top edges of the front and rear plates 318, 320 and surrounds the outlet 326.

From the initial flow conduit 322, the air/water/dirt mixture flows into recovery tank 30 which is an assembly of a bottom member 308 and a top member 310 having a top wall 364, a pair of sidewalls 366, and a rear wall 368. The working air flows from the initial flow conduit 322 to an intermediate working air flow conduit 330 which is defined by a depression 332 formed in the top wall 364 of the recovery tank 30 and a cover plate 336 secured thereto. The depression 332 comprises a bottom wall 338 and a pair of opposed sidewalls 340. Preferably, the sidewalls 340 initially taper inwardly from the inlet 342 of the intermediate working air conduit a short distance and then ultimately extend parallel to one another approaching the outlet 344 of the intermediate working air conduit 330. Preferably, the cover plate 336 is formed of a transparent, plastic material, and the top wall 364 and sidewalls 346 of the recovery tank 30 are formed of a smokey, translucent material. Utilizing these materials and the structure of the intermediate flow conduit 330, the user can easily observe the dirt and water passing up through the intermediate flow conduit 330 and also easily observe the fluid level inside the recovery tank 30.

The outlet 344 of the intermediate flow conduit 330 is positioned immediately adjacent an air/water separator baffle 350 which is integrated into the recovery tank 30 and is formed by a downwardly extending rear wall 352, a pair of parallel, downwardly extending sidewalls 354, and a bottom wall 356 extending forwardly from the rear wall 352. With this structure, the working air flow enters the hollow interior of the recovery tank 30 and is immediately redirected approximately 180° as it is directed downwardly into the tank interior. The water and dirt will enter the air/water separator baffle 350 and strike the various walls of the baffle 350 and fall downwardly into the tank.

In addition to the redirection of the working air flow as it enters the tank 30, the effective cross-sectional area of the working air conduit is dramatically increased as the air/water mixture passes from the intermediate working air conduit into the air/water separator baffle and the recovery tank. This sudden increase in cross-sectional area results in a significant drop in velocity for the working air, thereby assisting in the separation of dirt and water.

A fluid containment baffle 370 is mounted inside the hollow interior of the recovery tank 30 and is intended to prevent excessive sloshing of the recovered dirt and liquid and also contain any foam generated inside the tank. The baffle 370 comprises a front, downwardly extending portion 372 and a rear downwardly extending portion 374 which are spaced from one another but interconnected to one another by multiple stringers 376. The stringers 376 and edges of the front 372 and rear portions 374 define fluid apertures 378 therebetween. Preferably, the baffle 370 is mounted to the rear wall 368, sidewalls 366, and top wall 364 of the top member 310 a spaced distance from the bottom member 308. Preferably, the fluid flow apertures 378 are positioned immediately below the air/water separator 350 so that as the dirt and water drop therefrom, they pass through the apertures 378 into the lowermost portion of the recovery tank 30.

The front 372 and rear 374 portions of the baffle 370 are contoured to prevent excessive sloshing of the recovered liquid during movement of the cleaner 12. For example, when the user is moving the base assembly 14 forward and then reverses the direction and pulls the base assembly 14 rearwardly, the water and dirt present within the tank will surge toward the front of the recovery tank 30. The water will strike the sloping top wall 364 of the recovery tank 30 and be deflected rearwardly. Any water which may be deflected upwardly will strike the downwardly extending front portion 372 of the baffle 370 and, therefore, be deflected downwardly to the lowermost portion of the recovery tank 30. The downwardly extending rear portion 374 of the baffle 370 will similarly deflect fluid downwardly. The baffle 370 serves to prevent excessive sloshing of fluid in the tank and also provides the added benefit of containing any foam which may build up in the tank beneath the baffle 370 spaced away from the air/water separator 50 and fluid outlet.

An air flow outlet stand pipe 380 is integrally formed into the bottom member 308 and is provided at the rear of the recovery tank 30. The stand pipe extends upwardly to a point adjacent the uppermost portion of the recovery tank 30, opposite the outlet of the air/water separator baffle 350. In addition, the inlet opening 382 of the stand pipe 380 is positioned vertically above the baffle 370. With this structure, the substantially dry air exiting the air/water separator 350 will pass around the bottom 356 and sidewalls 354 of the air/water separator 350 and through the inlet opening 382 of the stand pipe 380, whereas the dirt and water will fall through the baffle apertures 378 into the lowermost portion of the recovery tank 30.

A manifold chamber 384 is formed at the bottom of the stand pipe 380 and defined by the bottom member 308 and the base pan 24. Preferably, an elastomeric gasket 388 is mounted to the top of the manifold chamber 384 to create a substantially air-tight seal between the bottom of the stand pipe 380 and the manifold chamber 384. A flexible conduit hose 386 extends from one end of the manifold to the impeller fan chamber mounted in the lower portion of the upper housing 16. In view of the fact that the upper housing 16 pivots with respect to the base pan 24 and recovery tank 30, the conduit 386 is preferably formed of a pliable, yet durable material.

A float 390 is provided inside the recovery tank 30 to prevent overfilling of the recovery tank 30 with fluid. The float 390 comprises a buoyant base 392 and a closure plate 394 interconnected to one another by a support plate 396. The closure plate 394 is dimensioned to fully seal the inlet opening 382 of the stand pipe 380 and prevent the flow of air or liquid therethrough.

The float 390 is limited primarily to vertical movement with respect to the recovery tank 30, the closure plate is positioned above the fluid containment baffle 370, and the buoyant base 392 of the float 390 is positioned below the fluid containment baffle 370. The fluid containment baffle 370 also includes an aperture 398 through which the stand pipe 380 extends. In addition, a narrow slot 400 is also provided in the rear portion 374 of the fluid containment baffle 370 through which the support plate 396 of the float 390 extends. In the assembled position, the closure plate 394 is positioned above the fluid containment baffle 370, and the buoyant base 392 is positioned below the baffle 370. Movement of the float is constrained because the buoyant base is captured in a float cage defined by the front wall 402 of the stand pipe 380, a pair of L-shaped walls 404, 406 extending up from the bottom member 308, a substantially planar wall 408 extending upwardly from the bottom member 308 intermediate the two L-shaped wall members 404, 406 and the rear portion 374 of the fluid containment baffle 370. Multiple slots 412 or fluid flow apertures are provided between the wall members 404, 406, 408 and the stand pipe 380 so that fluid will quickly and easily flow into the float cage defined by these elements. As the fluid within the tank and the float cage rises, so will the float 390 until eventually, the closure plate 394 nears the inlet opening 382 of the stand pipe 380 and is sufficiently drawn up against the stand pipe 380 to close the air flow therethrough. Once this happens, the sound of the operating vacuum motor 74 will change dramatically, warning the user that the recovery tank 30 is full and must be emptied.

The recovery tank 30 is quickly and easily emptied by first tilting the handle 18 and upper housing 16 rearwardly. Then, the latches 32 are disengaged from the projections 34 on the recovery tank 30. The user grasps the handle 36 and merely lifts the tank 30 from the base pan 24 and transports it to an appropriate site for emptying the tank 30. The tank 30 is emptied by removing a cap 414 mounted to the drainage aperture 416 provided on the rear wall 368 of the tank 30. Once the tank 30 has been emptied, the cap 414 is replaced, the tank 30 is lowered down onto the base pan 24, and finally, the latches 32 are snapped over the projections 34 to lock the tank to the base assembly 14.

As seen in FIG. 2, the entirety of the accessory hose 52 is contained on the accessory hose storage rack 50 when the cleaning machine 12 is used for on-the-floor cleaning or when the machine is being stored. When it is desired to use the accessory hose 52, the user unsnaps the grip tube 64 from the C-shaped clip 66 of the hose rack 50 and unwinds the hose therefrom and then removes the accessory hose mounting member 62 from its corresponding C-shaped clip on the storage rack 50. Next, the user removes the cap 420 from the recovery tank 30 cover plate 336 exposing the accessory hose flow aperture 422 and inserts the accessory hose mounting member 62 therein. The mounting member 62 comprises a elbow-shaped rigid conduit 424 which receives the flexible hose on one end thereof and a triangular-shaped mounting plate 426 on the other end thereof.

Figure 11:
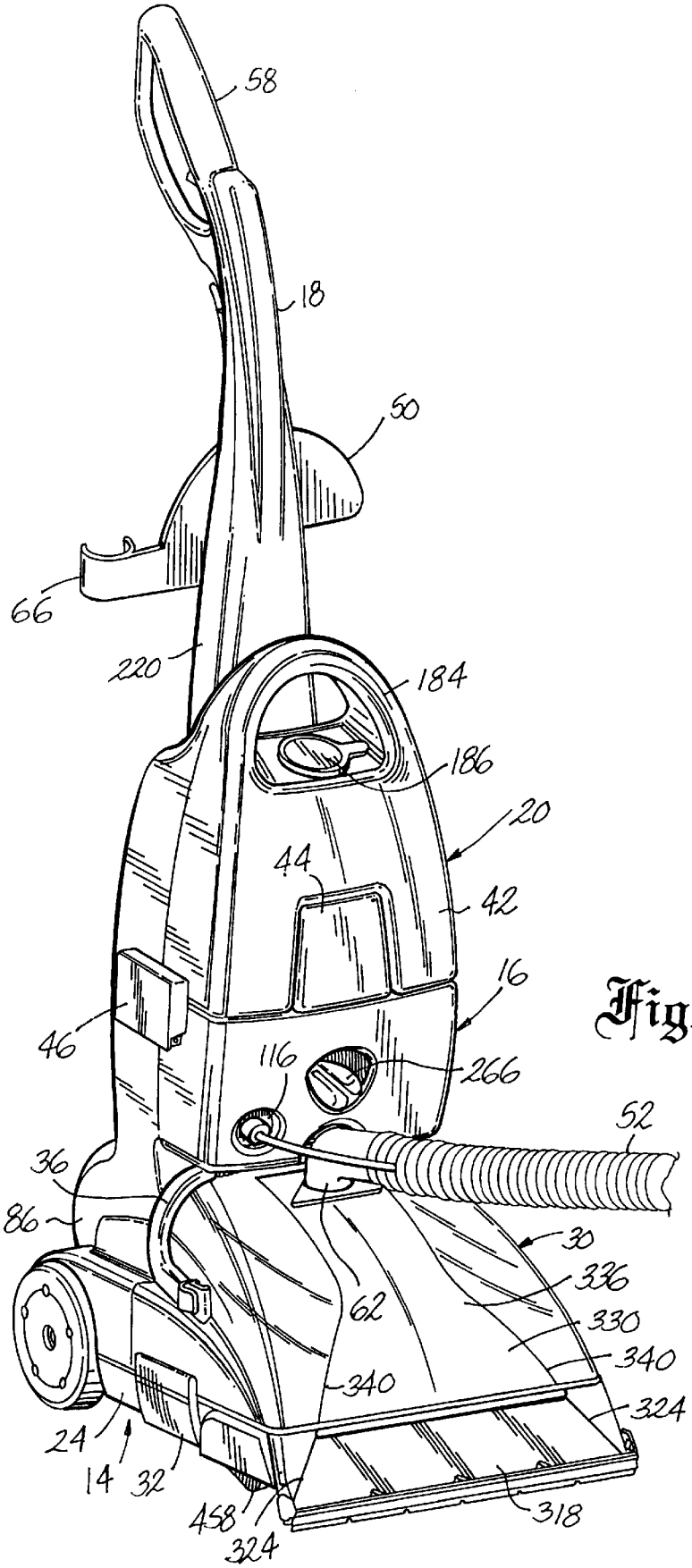
FIG. 11 is a front, perspective view of the upright water extraction cleaning machine of FIG. 1 showing the accessory hose mounted in the operative position.
Figure 12:
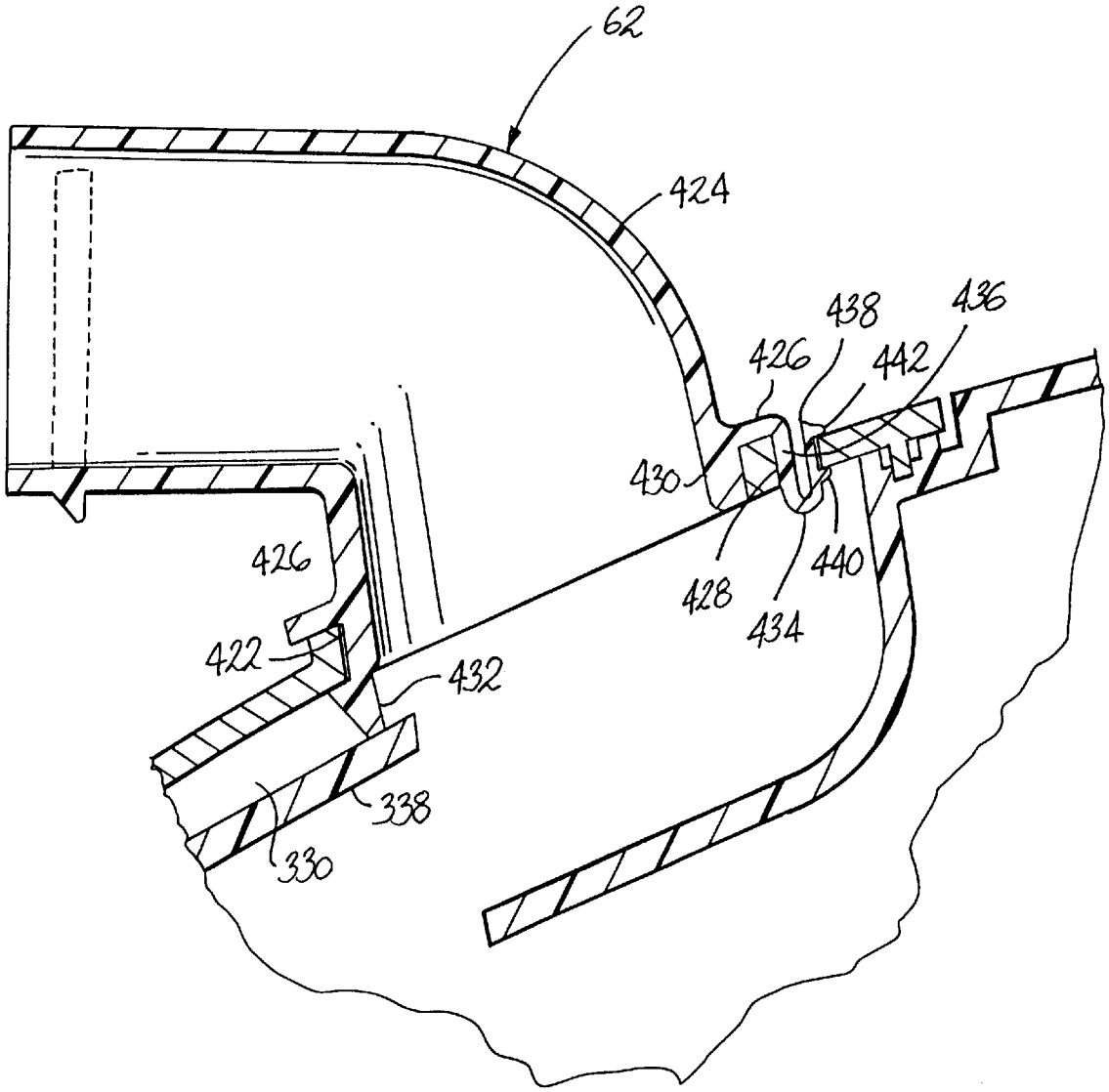
FIG. 12 is a partial, sectional view showing the mounting of the accessory hose to the recovery tank.

As seen in FIGS. 11 and 12, the accessory hose flow aperture is preferably formed immediately above the air/water separator baffle 350 when the cover plate 336 is mounted to the top member 310 of the recovery tank 30. A lock aperture 428 is also formed in the closure plate 336, immediately adjacent the accessory hose flow aperture 422. The accessory hose mounting member 62 comprises a flange 430 which extends downwardly from the triangular support plate 426. The flange 430 is substantially complimentary to the inside edge of the aperture 422 and is adapted to be snugly received therein. A baffle wall 432 extends downwardly along one of the three edges of the triangular flange 422. The baffle 432 extends substantially the entire width of the intermediate working air conduit 330 and extends downwardly a sufficient distance to contact the bottom wall 338 of the conduit to effectively seal the intermediate flow conduit 330 from the air/water separator baffle 350 and the vacuum motor 74. Therefore, substantially all of the working air drawn into the recovery tank 30 comes from the accessory hose 52.

The accessory hose mounting member 62 is retained in the aperture 422 by a U-shaped spring arm 434 which is received in and substantially seals the lock aperture 428. The spring arm 434 comprises a pair of opposed legs 436, 438, one of which extends downwardly from the triangular-shaped support plate. A locking barb 440 is provided on the outside edge of the free leg 438, and a projection 442 is provided at the terminal end of the free leg 438. In use, the bight portion of the U-shaped arm 434 is initially inserted into the lock aperture 428. As the spring arm 434 is received in the aperture 428, the locking barb 440 bears against one edge of the aperture 428, thereby causing the free leg 438 to flex inwardly, toward the other leg 436. Eventually, the locking barb 440 will extend past the inside edge of the aperture 428, and the resilient U-shaped spring arm 434 will spring outwardly. The edge of the aperture 428 will be captured between the outer projection 442 and the locking barb 440 of the spring arm 434. When the user desires to remove the accessory hose mounting member 62 from the aperture 422, the user squeezes the free leg 438 toward the inner leg 436 a sufficient distance to bring the locking projection 440 out of contact with the aperture edge. Then, the user lifts the mounting member 62 a sufficient distance to withdraw the spring arm 434, triangular-shaped flange 430, and baffle 432 from the aperture 422. Finally, the user repositions the cap 420 in the aperture 422 thereby effectively scaling the aperture 422.

As seen in FIGS. 9 and 10, the structure of the cap 420 is quite similar to the accessory hose mounting member 62 in that it includes an identical spring arm 446 and a substantially complimentary triangular flange extending downwardly therefrom. One key distinction is that the cap 420 does not include the downwardly extending baffle wall which seals the intermediate working air flow path 330.

Figure 13:
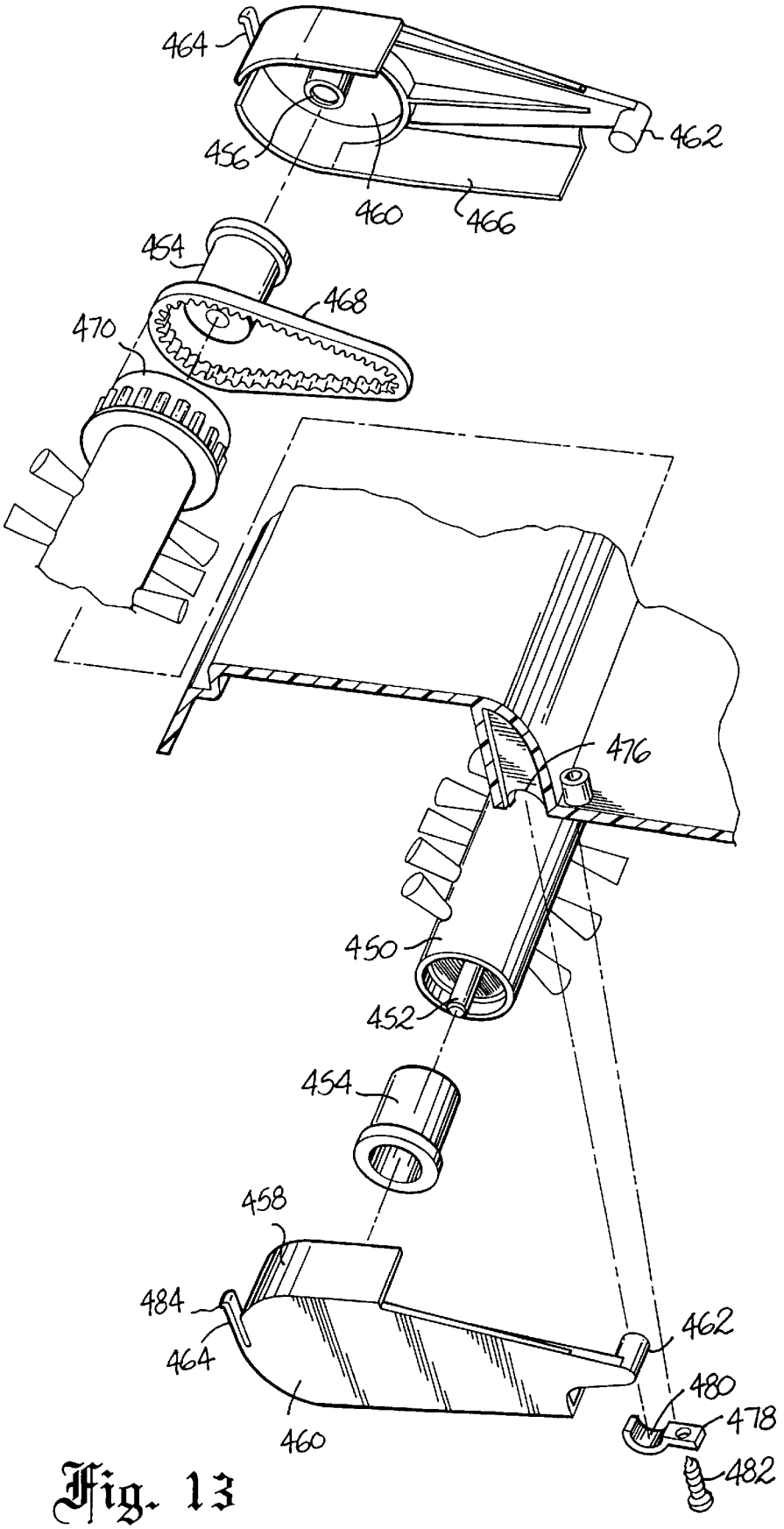
FIG. 13 is a partial, exploded view of the agitation brush assembly and base pan.

The preferred embodiment of the cleaning machine 12 includes a rotatively mounted agitation brush which is adapted for easy and instantaneous vertical adjustment. As seen in FIGS. 9 and 13, the agitation brush assembly comprises a brush dowel 450 fixedly mounted on a shaft 452. The ends of the shaft 452 are received in bearings 454 which, in turn, are telescopically mounted on inwardly extending bosses 456 provided on a pair of opposed articulating arm members 458. Each arm member 458 comprises a back plate 460 with a pivot pin 462 provided at the rear of the plate 460 and a limit arm 464 provided at the front of the plate 460. In addition, a laterally extending belt guard 466 is preferably integrally formed with the articulating arm 458. The belt guard 466 extends laterally inwardly enough to cover the drive belt 468 in the assembled position.

The belt guard 466 protects the belt 468 from threads and other foreign material becoming lodged therein and also protects the carpet or other surface positioned below the base assembly 14 from the rotating belt 468. The drive belt 468 extends around a pulley 470 mounted at one end of the brush dowel 450 and a drive shaft and pulley 472 of the brush motor 474.

The pivot pins 462 of the arm member 458 are captured between a semi-circular shaped bearing surface 476 integrally formed into the bottom of the base pan 24 and a retaining member 478 having a bearing surface 480 formed thereon. The pivot pin 462 is captured between the bearing surfaces 480, 476 of the retaining member 478 and the base pan 24. The retaining member 478 is secured to the base pan 24 by a conventional fastener, such as a screw 482.

The limit arms 464 provided at the front of the retaining members 478 are adapted to limit the downward movement of the brush assembly relative to the base pan 24. Each limit arm 464 has a forwardly extending barb 484 provided at the terminal end of the arm 464. In the operative position, the barb 484 is positioned above a rearwardly extending projection 486 provided on the base pan 24. As seen in FIG. 9, as the agitation brush assembly extends further and further downward, the barb 484 on the end of the limit arm 464 will contact the projection 486 and prevent any further downward movement. With this floating agitation brush assembly, the cleaning machine 12 according to the invention can almost instantaneously adapt to varying carpet naps or other inconsistencies on the surface being cleaned. The brush arms also allow the rotating brush to drop below the normal floor plane to provide contact when a bare floor cleaning attachment raises the suction nozzle opening height from the floor.

Figure 14:
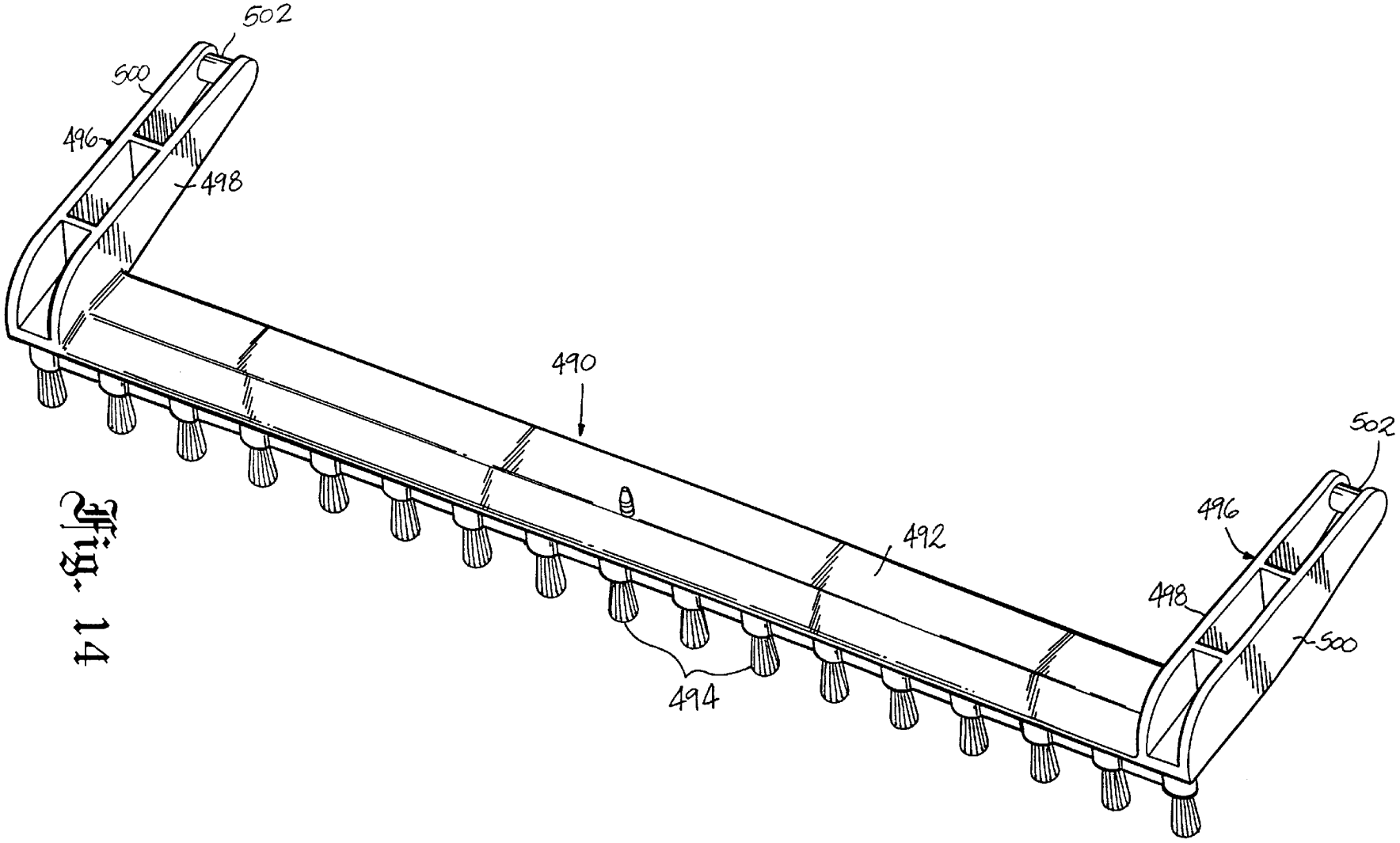
FIG. 14 is a perspective view of an alternative embodiment of the agitation brush of FIG. 13.

As an alternative to the floating, rotatably mounted agitation brush as seen in FIGS. 9 and 13, a floating strip agitation brush 490 could be incorporated in the cleaning machine 12 according to the invention, as seen in FIG. 14. The floating strip agitation brush 490 is easily adapted for incorporation into the cleaning machine 12 according to the invention. In this embodiment, the strip brush 490 comprises a linear brush body 492 with bristles 494 extending downwardly therefrom and a pair of integrally molded arms. Each of the arms 496 is formed by a pair of opposed plates 498, 500 and a pivot pin 502 extending between the rearmost edge of the opposed plates 498, 500. The pivot pins 502 in this embodiment are secured to the base pan 24 in the same manner as shown previously in FIG. 13. Namely, the pivot pins 502 are captured between the bearing surface 476 of the base pan 24 and the bearing surface 480 formed on the retention member 478 which is securely fastened to the base pan 24 by conventional fasteners 482. With this structure, the strip brush 490 can move vertically in response to changes in the carpet nap or other inconsistencies in the surface being cleaned.

Figure 15:
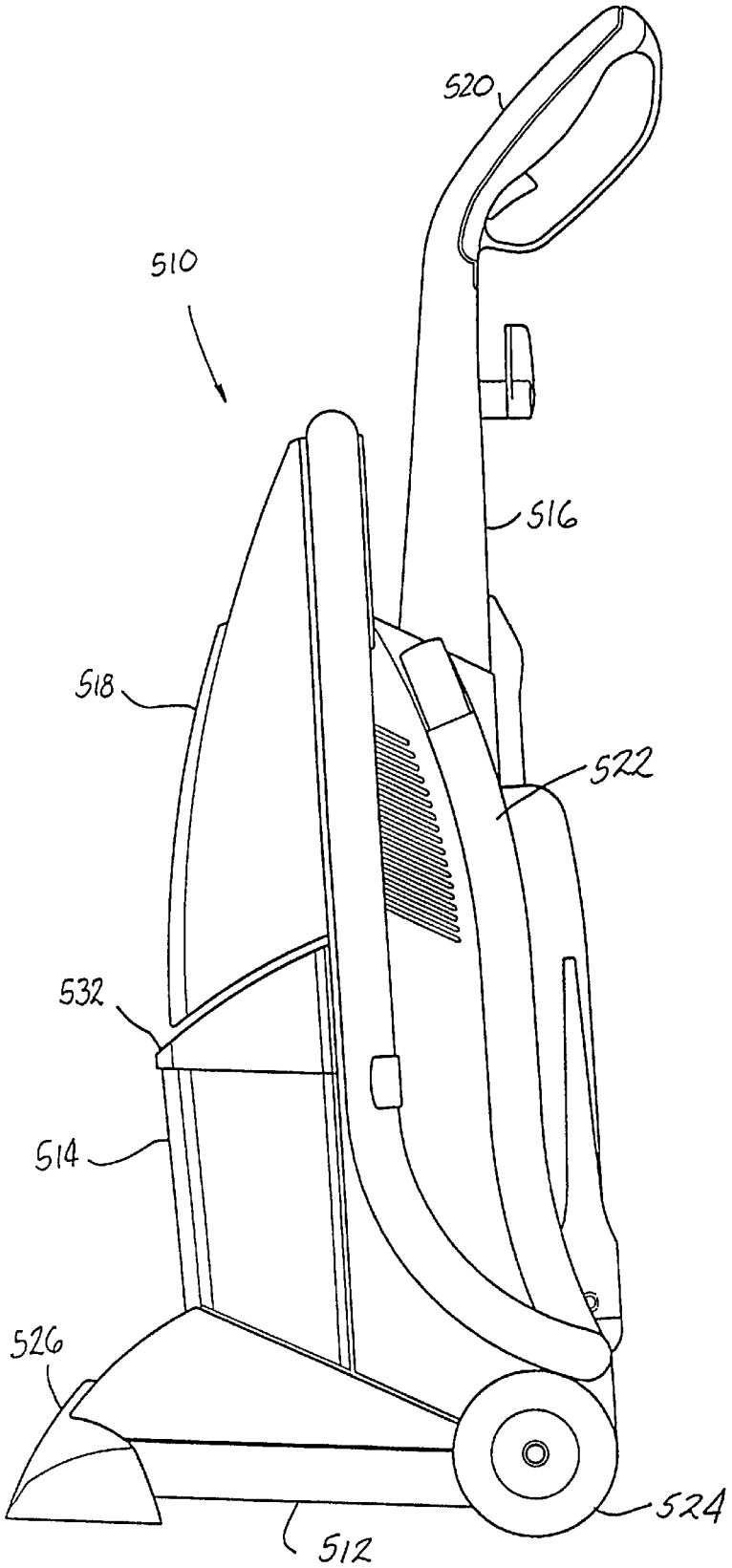
FIG. 15 is a side-elevational view of a second embodiment of the upright water extraction cleaning machine according to the invention.
Figure 16:
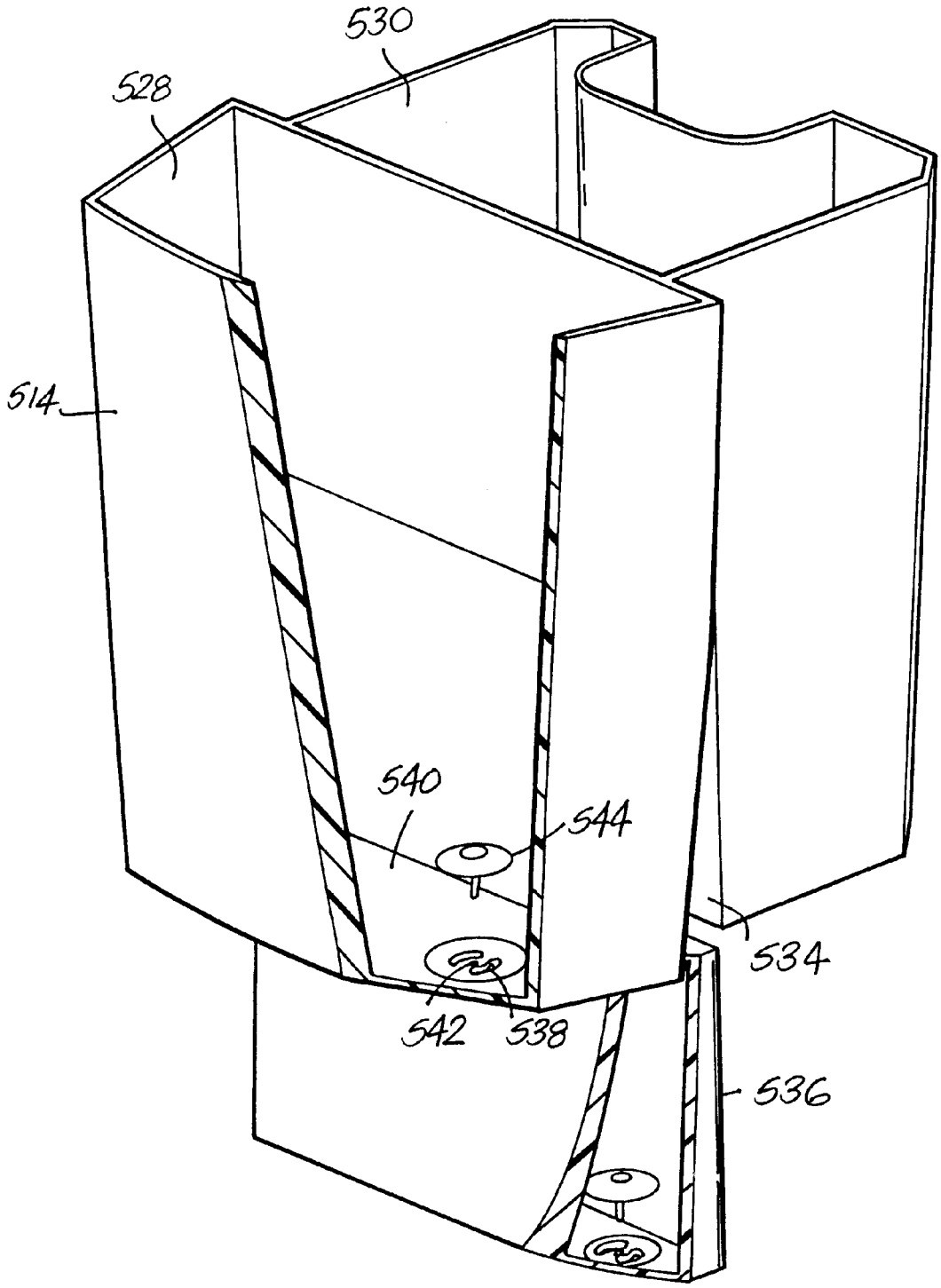
FIG. 16 is a perspective view of the tank assembly of the upright water extraction cleaning machine of FIG. 15.

A second embodiment of the upright water extraction cleaning machine according to the invention is seen in FIGS. 15 and 16. In this embodiment, the machine 510 comprises a base 512, a tank housing 514 selectively mounted on the base 512, an elongated support member 516 pivotally mounted to the base at one end, an upper housing 518 securely mounted to the other end of the elongated support member 516, a hand grip 520 provided at the top of the elongated support member 516, and an accessory hose 522. The base 512 comprises a suction nozzle assembly 526 provided at the front edge of the base 512 and a pair of wheels 524 rotatably supporting the rear of the base. A conventional cleaning solution pump (not shown) is provided in the base and fluidly connected to the tank housing 514.

The tank housing 514 is preferably molded as a single article and comprises a clean water chamber 528, a dirty water chamber 530, and an air/water separator lid 532 which is removably mounted to the top of the housing and adapted to close the open tops of clean and dirty water chambers 528, 530. The clean water chamber 528 is in adjacent juxtaposition to the dirty water chamber 530. A recess 534 is provided in the bottom of the tank housing 514 between the clean water chamber 528 and the dirty water chamber 530 and is adapted to selectively receive a detergent cartridge 536. The cartridge nests into the recess 534 so that the tank housing and detergent cartridge 536 can be removed from and installed simultaneously on the base 512.

Similar to the first embodiment, the clean water chamber 528 and detergent cartridge include one-way valve mechanisms adapted to interface with the solution distribution system of the base. A portion of the clean water chamber 528 and detergent cartridge 536 are broken away to show the valve mechanism. The one-way valve mechanisms of the clean water chamber and the detergent cartridge 536 are identical, and therefore, the system will be described only for the clean water chamber.

A pair of fluid flow apertures 538 are formed in the bottom wall 540 of the tank housing 514. Immediately adjacent to the fluid flow aperture is a valve stem aperture 542 adapted to receive and support the stem of a conventional umbrella valve member 544. When the tank housing is properly received on the base, a projection extends upwardly from the base, through at least one of the fluid flow apertures 538, to deflect the umbrella valve upward and permit the flow of fluid through the apertures to the mixing valve as described previously. When the tank housing 514 is lifted from the base 512, the projection is withdrawn from the aperture 538 which is resealed by the umbrella valve member 544.

The water extraction cleaning machine according to the invention overcomes several of the problems of the prior art. Namely, the cleaning machine is easily adapted for a variety of cleaning operations. For example, the detergent to water mixture ratio can be altered nearly instantaneously. In addition, the height of the agitation brush with respect to the suction nozzle opening changes immediately in response to changes in the carpet nap and other inconsistencies in the surface being cleaned. The cleaning machine according the invention also provides easy and convenient means for filling and emptying the clean water and detergent tanks. Similarly, the recovery tank can be quickly and easily removed for emptying or cleaning. Finally, the accessory hose intended for use with the cleaning machine according to the invention is preferably stored on the machine at all times when not in use. This minimizes the storage space required for the machine and accessories and simultaneously ensures that the user has all attachments and accessories contained on the machine, regardless of where the machine is being used.

Reasonable variation and modification are possible within the spirit of the foregoing specification and drawings without departing from the scope of the invention.

The embodiments for which an exclusive property or privilege is claimed are defined as follows:

1. An improved upright water extraction cleaning machine comprising a housing which includes a base module adapted to roll across a supporting surface and a handle pivotally mounted to the base, a cleaning solution pump mounted to the housing and connected to a source of cleaning solution, at least one spray nozzle mounted on the base housing and connected to the pump to receive pressurized cleaning solution and distribute it onto a surface being cleaned, a suction nozzle mounted to the base module to remove cleaning solution from the supporting surface, a recovery tank mounted to the base module and in fluid communication with the suction nozzle and a vacuum motor mounted to the housing and connected to the suction nozzle and the recovery tank to generate a working air flow from the suction nozzle through the recovery tank for recovering used cleaning fluid and dirt the improvement comprising:

a tank assembly removably mounted to the housing in an operative position the tank assembly comprising a clean water tank and a detergent tank wherein the detergent tank is slidably mounted in a recess provided in at least one of said clean water tank and said recovery tank.

2. An improved upright water extraction cleaning machine according to claim 1 wherein the recess is formed at least in part in the clean water tank.

3. An improved upright water extraction cleaning machine according to claim 2 wherein the tank assembly is slidably mounted to the handle.

4. An improved upright water extraction cleaning machine according to claim 3 and further comprising a hand grip integrally molded into the clean water tank.

5. An improved upright water extraction cleaning machine according to claim 2 wherein the recess has sidewalls and the detergent tank has sidewalls and further comprising at least one groove formed on one of the sidewalls of the recess and the sidewalls of the detergent tank and at least one projection formed on the other of the sidewalls of the recess and the sidewalls of the detergent tank, the detergent tank being slidably mounted in the recess through the sliding engagement of the at least one projection in the at least one groove.

6. An improved upright water extraction cleaning machine according to claim 5 wherein the at least one recess is formed on the sidewall of the clean water tank, the at least one projection is formed on the sidewall of the recess and the at least one projection is substantially complementary to the at least one groove.

7. An improved upright water extraction cleaning machine according to claim 2 wherein the clean water tank has front and bottom walls, and the recess is formed in both the front and bottom walls of the clean water tank.

8. An improved upright water extraction cleaning housing according to claim 7 and further comprising at least one one-way valve mechanism mounted in the bottom wall of each of the clean water and detergent tanks, the one-way valve mechanisms adapted to prevent the flow of fluid therethrough when the tanks are removed from the machine and adapted to permit the flow of fluid therethrough to a cleaning solution pump when the tanks are mounted to the machine in the operative position.

9. An improved upright water extraction cleaning machine according to claim 2 and further comprising a mounting groove formed in a rear wall of the clean water tank, the mounting groove being defined by a pair of opposed sidewalls and a front wall, the mounting groove being adapted to slidably receive at least a portion of the handle when the tank assembly is mounted to the handle in the operative position.

10. An improved upright water extraction cleaning machine according to claim 9 wherein the handle has sidewalls and further comprising at least one projection groove formed on one of the sidewalls of the handle and the sidewalls of the mounting groove and at least one projection formed on the other of the sidewalls of the handle and sidewalls of the mounting groove, the at least one projection being slidably received in the at least one projection groove and these elements being aligned so that the tank assembly is properly received on the handle in the operative position when the tank assembly is slidably received on the handle.

11. An improved upright water extraction cleaning machine according to claim 1 wherein the clean water tank and the recovery tank are in adjacent horizontal juxtaposition, and the recess is formed between the clean water tank and the recovery tank.

12. An improved upright water extraction cleaning machine according to claim 11 wherein the tank assembly is selectively mounted to the base.

13. An improved upright water extraction cleaning machine according to claim 11 wherein the recess extends upwardly from a bottom portion of the clean water tank and the recovery tank.

14. An improved upright water extraction cleaning machine according to claim 13 and further comprising at least one one-way valve mechanism mounted in the bottom wall of each of the clean water chamber and detergent tanks, the one-way valve mechanisms adapted to prevent the flow of fluid therethrough when the tanks are removed from the machine and adapted to permit the flow of fluid therethrough to the cleaning solution pump when the tanks are mounted to the machine in an operative position.

15. An improved upright water extraction cleaning machine comprising a housing which includes a base module adapted to roll across a supporting surface and a handle pivotally mounted to the base module, a cleaning solution pump mounted to the housing and connected to a source of cleaning solution, at least one spray nozzle mounted to the base module and connected to the pump to receive pressurized cleaning solution and distribute it onto a surface being cleaned, a suction nozzle mounted to the base module to remove cleaning solution from the supporting surface, and a vacuum motor mounted to the housing and connected to the suction nozzle to generate a working air flow for recovering used cleaning fluid and dirt, the improvement comprising:

a tank assembly slidably mounted to the handle in an operative position, the tank assembly comprising a clean water tank and a detergent tank, the detergent tank being slidably mounted in a recess provided in the clean water tank; and a recovery tank removably mounted to the base module, the recovery tank being fluidly connected to the vacuum motor.

16. An improved upright water extraction cleaning machine according to claim 15 and further comprising at least one one-way valve mechanism mounted in a bottom wall of each of the clean water and detergent tanks, the one-way valve mechanisms adapted to prevent the flow of fluid therethrough when the tanks are removed from the machine and adapted to permit the flow of fluid therethrough to a cleaning solution pump when the tanks are mounted to the machine in the operative position.

17. An improved upright water extraction cleaning machine according to claim 15 wherein the recess has sidewalls and the detergent tank has sidewalls and further comprising at least one groove formed on one of the sidewalls of the recess and the sidewalls of the detergent tank and at least one projection formed on the other of the sidewalls of the recess and the sidewalls of the detergent tank, the detergent tank being slidably mounted in the recess through the sliding engagement of the at least one projection in the at least one groove.

18. An improved upright water extraction cleaning machine according to claim 15 and further comprising a mounting groove formed in a rear wall of the clean water tank, the mounting groove being defined by a pair of opposed side walls and a front wall, the mounting groove being adapted to slidably receive at least a portion of the handle when the tank assembly is mounted to the handle in the operative handle.

19. An improved upright water extraction cleaning machine according to claim 18 wherein the handle has sidewalls and further comprising at least one projection groove formed on one of the sidewalls of the handle and the sidewalls of the mounting groove and at least one projection formed on the other of the sidewalls of the handle and sidewalls of the mounting groove, the at least one projection being slidably received in the at least one projection groove and these elements being aligned so that the tank assembly is properly received on the handle in the operative position when the tank assembly is slidably received on the handle.

* * * * *

UNITED STATES PATENT AND TRADEMARK OFFICE
CERTIFICATE OF CORRECTION

PATENT NO.: 5,896,617

DATED: April 27, 1999

INVENTOR(S): KASEN ET AL.

It is certified that error appears in the above-identified patent and that said Letters Patent are hereby corrected as shown below:

Claim 1, col. 15, line 20, "position the" should read --position, the--

Claim 8, col. 15, line 54, "housing" should read --machine--

Claim 8, col. 15, line 62, "machine" should read--housing--

Signed and Sealed this

Twenty-sixth Day of October, 1999

*Attest:*

Q. TODD DICKINSON

*Attesting Officer*

*Acting Commissioner of Patents and Trademarks*